US006349416B1

(12) United States Patent
Lampe et al.

(10) Patent No.: US 6,349,416 B1
(45) Date of Patent: Feb. 26, 2002

(54) HEADGUARD-PROTECTIVE SPORTS HEADBAND

(75) Inventors: John K. Lampe; Robert C. Long; George C. Halvorson, all of St. Paul, MN (US)

(73) Assignee: Soccordocs, Inc., St. Paul, MN (US)

( * ) Notice: Subject to any disclaimer, the term of this patent is extended or adjusted under 35 U.S.C. 154(b) by 15 days.

(21) Appl. No.: 09/621,848

(22) Filed: Jul. 24, 2000

Related U.S. Application Data

(60) Provisional application No. 60/145,114, filed on Jul. 23, 1999.

(51) Int. Cl.[7] ..... A42B 3/00

(52) U.S. Cl. ..... 2/411; 2/417; 2/425; 2/DIG. 11

(58) Field of Search ..... 2/417, 410, 418, 2/411, 412, 414, 425, DIG. 11

(56) References Cited

U.S. PATENT DOCUMENTS

| | | | | |
|---|---|---|---|---|
| 532,567 | A | 1/1895 | Larwood, Jr. | |
| 2,969,547 | A | 1/1961 | Dye | 2/3 |
| 3,171,133 | A | 3/1965 | Steffen | 2/3 |
| 3,725,956 | A | 4/1973 | Reisen | 2/200 |
| 3,784,984 | A | 1/1974 | Aileo | 2/3 R |
| 3,992,721 | A | 11/1976 | Morton | 2/3 R |
| 4,023,209 | A | 5/1977 | Frieder, Jr. et al. | 2/6 |
| 4,044,400 | A | 8/1977 | Lewicki et al. | 2/421 |
| 4,058,854 | A | 11/1977 | Rhee | 2/412 |
| 4,062,067 | A | 12/1977 | Franzen | 2/410 |
| 4,075,717 | A | 2/1978 | Lemelson | 2/412 |
| 4,239,106 | A | 12/1980 | Aileo | 206/223 |
| 4,290,149 | A | 9/1981 | Aileo | 2/414 |
| 4,317,239 | A | 3/1982 | Bryksa | 2/411 |
| 4,345,336 | A | 8/1982 | Plastino | 2/187 |
| 4,354,284 | A | 10/1982 | Gooding | 2/413 |
| 4,398,306 | A | 8/1983 | Gooding | 2/421 |
| 4,404,690 | A | 9/1983 | Farquharson | 2/420 |

(List continued on next page.)

FOREIGN PATENT DOCUMENTS

| | | | | |
|---|---|---|---|---|
| FR | 2390116 | * | 1/1979 | 2/412 |
| GB | 2 202 729 A | | 10/1988 | A42B/3/00 |
| GB | 2318500 | * | 4/1998 | |
| GB | 2333690 | * | 8/1999 | |
| WO | 8804188 | * | 6/1988 | 2/410 |
| WO | 9929199 | * | 6/1999 | |

OTHER PUBLICATIONS

Seven Photographs of "Gilbert Rugby" head protector, date unknown.

Seven Photographs of "CCC" head protector, date unknown.

Fellow, Fishbein, "Can Sports–Minded Kids Have Too Many Helmets?", *Medical News and Perspectives*, vol. 275, No. 18, p. 1391, May 8, 1996.

Tysvaer, Alf Thorvald, Head and Neck Injuries in Soccer, Impact of Minor Trauma, *Sports Medicine*, vol. 14, No. 3, p. 200–213, 1992.

*Primary Examiner*—Rodney M. Lindsey
(74) *Attorney, Agent, or Firm*—Michael S. Sherrill

(57) ABSTRACT

Protective headguard to be worn by an athlete having (i) a protective central pad, (ii) a rear pad, (iii) an adjustable strap system interconnecting the rear pad and the central pad, and (iv) one or more of (a) a lack of any protective padding which would cover the side of the athlete's head when the headguard is worn, (b) a channel defined by the central pad extending substantially horizontally above the athlete's brow ridges and below the athlete's frontal bone when the headguard is worn, (c) a slot in the rear pad extending substantially vertically from the athlete's occipital bone and accommodating passage of a ponytail when the headguard is worn, (d) a single unitary liner, (e) bands encircling the central pad and releasably securing a liner to the central pad, (f) a removable sleeve, (g) a spine pad extending from the front panel to the rear pad (h) perceptible lines of demarcation on the exterior surface of the central pad.

30 Claims, 30 Drawing Sheets

U.S. PATENT DOCUMENTS

| | | | | | |
|---|---|---|---|---|---|
| 4,443,891 | A | | 4/1984 | Blomgren et al. | 2/414 |
| 4,481,681 | A | | 11/1984 | Hankin | 2/197 |
| 4,484,364 | A | | 11/1984 | Mitchell et al. | 2/413 |
| 4,539,715 | A | | 9/1985 | Clement | 2/420 |
| 4,558,470 | A | | 12/1985 | Mitchell et al. | 2/414 |
| 4,581,773 | A | | 4/1986 | Cunnane | 2/204 |
| 4,612,672 | A | | 9/1986 | Schrack | 2/68 |
| 4,613,993 | A | | 9/1986 | Steele et al. | 2/411 |
| 4,646,367 | A | | 3/1987 | El Hassen | 2/411 |
| 4,698,852 | A | | 10/1987 | Romero | 2/171 |
| 4,706,305 | A | | 11/1987 | Cho | 2/425 |
| 4,710,985 | A | | 12/1987 | Dubner et al. | 2/425 |
| 4,766,614 | A | | 8/1988 | Cantwell et al. | 2/414 |
| 4,768,231 | A | | 9/1988 | Schrack | 2/12 |
| 4,790,035 | A | | 12/1988 | Whyte | 2/207 |
| 4,827,537 | A | | 5/1989 | Villa | 2/410 |
| 4,843,642 | A | | 7/1989 | Brower | 2/6 |
| 4,864,662 | A | | 9/1989 | Frank | 2/183 |
| 4,910,804 | A | | 3/1990 | Lidgren | 2/209 |
| 4,947,488 | A | | 8/1990 | Ashinoff | 2/181 |
| 4,982,451 | A | | 1/1991 | Graham | 2/410 |
| 5,012,533 | A | | 5/1991 | Raffler | 2/420 |
| 5,042,093 | A | | 8/1991 | Legendre | 2/419 |
| 5,044,016 | A | | 9/1991 | Coombs | 2/414 |
| 5,075,903 | A | | 12/1991 | Richoux | 2/411 |
| 5,081,717 | A | | 1/1992 | Shedd et al. | 2/199 |
| 5,083,321 | A | | 1/1992 | Davidsson | 2/421 |
| 5,173,970 | A | | 12/1992 | Shifrin | 2/410 |
| 5,177,815 | A | | 1/1993 | Andujar | 2/411 |
| 5,184,354 | A | | 2/1993 | Alfaro et al. | 2/425 |
| D339,677 | S | | 9/1993 | Kang | D2/512 |
| 5,271,103 | A | | 12/1993 | Darnell | 2/418 |
| 5,315,718 | A | | 5/1994 | Barson et al. | 2/418 |
| 5,361,420 | A | | 11/1994 | Dobbs et al. | 2/425 |
| 5,392,468 | A | | 2/1995 | Leddick, III | 2/424 |
| 5,421,035 | A | | 6/1995 | Klose et al. | 2/411 |
| 5,437,064 | A | | 8/1995 | Hamaguchi | 2/414 |
| 5,450,631 | A | | 9/1995 | Egger | 2/425 |
| 5,504,945 | A | | 4/1996 | Purnell | 2/425 |
| 5,511,250 | A | | 4/1996 | Field et al. | 2/418 |
| D370,309 | S | | 5/1996 | Stucky | D29/102 |
| 5,515,546 | A | | 5/1996 | Shifrin | 2/410 |
| 5,519,895 | A | | 5/1996 | Barnes, Jr. | 2/422 |
| 5,535,454 | A | | 7/1996 | Ryan | 2/425 |
| 5,544,367 | A | | 8/1996 | March, II | 2/410 |
| 5,551,094 | A | | 9/1996 | Navone | 2/421 |
| 5,615,419 | A | | 4/1997 | Williams | 2/411 |
| 5,628,071 | A | | 5/1997 | Nezer | 2/410 |
| 5,638,551 | A | | 6/1997 | Lallemand | 2/421 |
| 5,640,721 | A | | 6/1997 | Jackson | 2/171 |
| 5,659,900 | A | | 8/1997 | Arney et al. | 2/417 |
| 5,661,854 | A | | 9/1997 | March, II | 2/410 |
| 5,680,656 | A | | 10/1997 | Gath | 2/424 |
| 5,701,609 | A | | 12/1997 | Bridges | 2/422 |
| 5,704,072 | A | | 1/1998 | Garneau | 2/421 |
| 5,774,901 | A | | 7/1998 | Minami | 2/421 |
| 5,790,988 | A | | 8/1998 | Guadagnino, Jr. et al. | 2/411 |
| 5,815,847 | A | | 10/1998 | Holden, Jr. | 2/418 |
| 5,862,528 | A | | 1/1999 | Saijo et al. | 2/411 |
| 5,882,205 | A | | 3/1999 | Peterson | 434/251 |
| D410,768 | S | | 6/1999 | Hirsh | D29/102 |
| 5,930,841 | A | * | 8/1999 | Lampe et al. | 2/411 |
| 5,946,734 | A | | 9/1999 | Vogan | 2/412 |
| 5,963,989 | A | | 10/1999 | Robertson | 2/411 |
| 6,000,062 | A | | 12/1999 | Trakh | 2/171 |
| 6,065,159 | A | | 5/2000 | Hirsh | 2/425 |

* cited by examiner

HEADGUARD-PROTECTIVE SPORTS HEADBAND

This application claims the benefit of U.S. Provisional Application No. 60/145,114, filed Jul. 23, 1999.

FIELD OF INVENTION

The present invention generally relates to protective headguards for athletes and, more particularly, relates to a protective headguard for soccer players. The purpose of the headguard is to provide protection to a soccer player's head from injuries encountered during play of the game without unduly disrupting the traditional way in which the game is played.

BACKGROUND OF THE INVENTION

Participants in many sports are increasingly using protective headgear of various kinds. Football players have long worn helmets to protect themselves from blows to the head and face. Sometime later hockey players also began to protect themselves with helmets. More recently recreational bicyclists have perceived the need to use protective headgear and have started to wear helmets in increasing numbers.

Traditionally, soccer players have not worn any protective headgear. This is probably the case for two main reasons. First, soccer players or organizers of the game may not have sensed a need to use headgear because injuries to the head may not have seemed as commonplace as in sports such as football, hockey, and bicycling. Second, soccer is one of the few sports where the head itself is intentionally and legitimately used to strike the ball. This requires considerable muscle coordination and use of the senses of sight and touch. An improperly constructed piece of headgear may hamper a player's ability to head the ball properly.

Recent medical research has demonstrated that head injuries may be more prevalent in soccer than previously thought. Several studies have suggested that soccer players may suffer minor trauma from repeatedly heading the ball. This injury has been analogized to pugilistic dementia, the harm that boxers suffer from repeated strikes to the head in boxing. Alf Thorvald, Head and Neck Injuries in Soccer—Impact of Minor Trauma, *Sports Medicine,* 14(3):200–213 (1992). This danger of trauma in soccer may be greater for children. Their skills at heading are less well honed. Their bodies may not be developed enough to withstand or counteract the blow caused by a ball. Id. at 210. Therefore, at least from a safety standpoint, use of headgear by soccer players seems advisable.

The unique demands of the sport of soccer require unique headgear. Although multipurpose protective headgear for sports are being developed, most forms of headgear for use in team sports are intended for one sport and should not be used in other activities. Thomas B. Cole, Can Sports Minded Kids Have Too Many Helmets?, *Journal of the American Medical Association,* 275(18): 1391 (May 8, 1996). A brief review of patents for headgear constructed for other sports shows how such headgear would not meet the specialized needs of soccer players. For example, football and hockey helmets are ill-suited for soccer. Their bulk would likely discourage soccer players unaccustomed to helmets from wearing them. In addition this bulk and the hard, sometimes uneven surfaces of such helmets would make it very difficult to control the direction and distance of a headed ball. Finally, other unprotected soccer players might suffer injuries caused by the hard-surfaced headgear of the wearer. See, e.g., U.S. Pat. No. 4,404,690 (hockey helmet).

Other helmets would also not work effectively as soccer headgear. Bicycle helmets are light but would make control of the ball difficult; they are built to withstand one substantial blow; and their ventilation systems would likely not be effective in soccer. See, e.g., U.S. Pat. No. 5,450,631. Wrestling headgear protects the ears and only incidentally, if at all, protects the surfaces of the head. See, e.g., U.S. Pat. No. 5,361,420.

U.S. Pat. No. 4,698,852 illustrates protective headgear specifically designed for use in soccer. This headgear, however, has several shortcomings. The headband shape of the headgear protects only the forehead, neglecting other parts of the head which may be used, properly, and improperly, to strike balls. The headband shape moreover creates a ridge at the edge of the headband which may misdirect a headed ball. In addition, the materials and retention system of this headgear likely would cause the headgear to slip up or down on the wearer's head or, if tightened, may strain the wearer's head.

SUMMARY OF THE INVENTION

Generally, the present invention relates to improvements to a headguard for athletes and in particular soccer players. The basic design of one embodiment of the invention is a headguard which includes a partial headcover consisting primarily of two pieces covering predominantly the rear and front portions of the head and connected together on either side of the head by elastic or other stretchable connectors.

The headguard is preferably constructed from two pads of molded, shockabsorbing foam. The basic design may consist of two panels, either connected solely by straps on the side of the head, or also connected by a "spine" which could be made of the same material as the panels and connected to the panels during the molding process. The panels may be manufactured as flat foam pieces. The panels can be bent and formed into three-dimensional, cupped shaped pieces that are held in a shape that best conforms to the head by, for example, channels molded into the foam, sewn seams, and tension created by stretchable adjustment straps.

Modifications to the basic design include the addition of or changes in (1) the spine, the portion of the headguard covering the top of the head; (2) padded inserts that may be placed on the interior of the headguard and the means by which those padded inserts are attached to the headguard; (3) the back panel of the headguard to better accommodate players with ponytails; (4) the channels on the exterior surface of the frontpiece; (5) the front or back panel to allow for the application of symbols such as logos or lettering; and (6) fabric sleeves covering the foam pads of the headguard.

The above summary of the present invention is not intended to describe each illustrated embodiment of the present invention. The figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
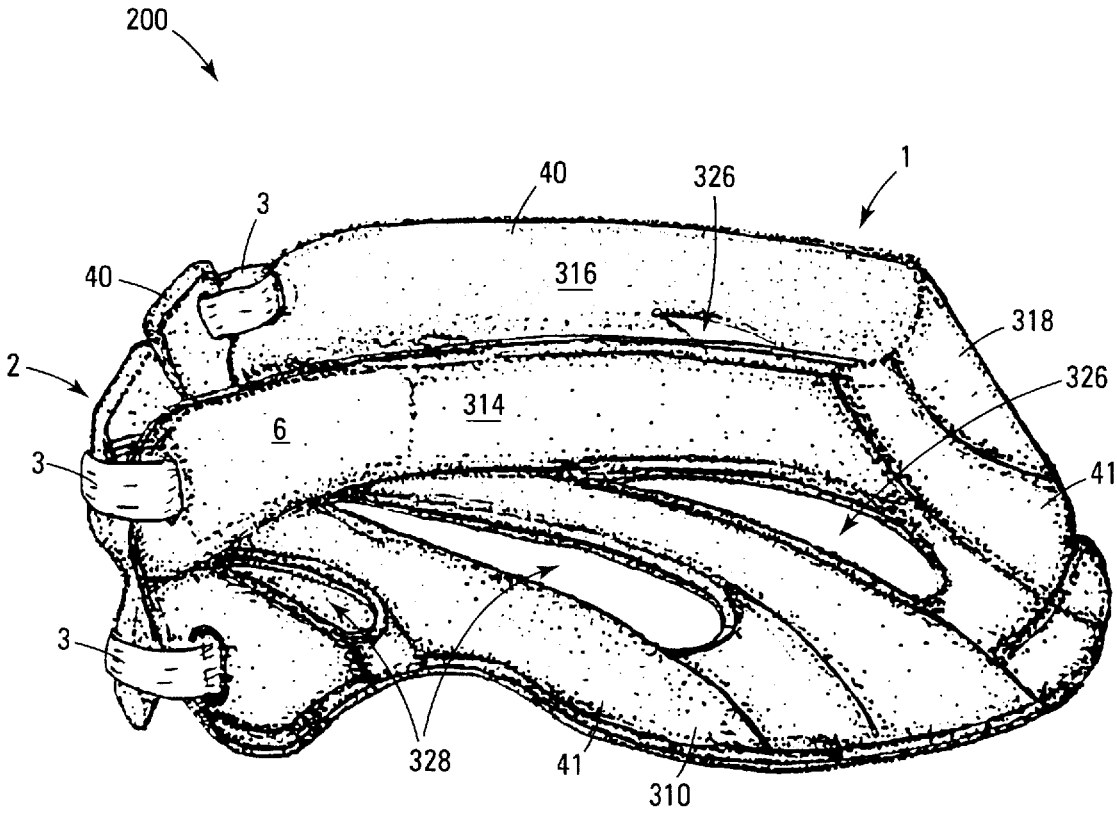
FIG. 1 is a perspective side view of an exemplary headguard in accordance with one embodiment of the invention.

While the invention is amenable to various modifications and alternative forms, specifics thereof have been shown by way of example in the drawings and will be described in detail. It should be understood, however, that the intention is not to limit the invention to the particular embodiments described, although all embodiments described are intended to fall within the claims of this invention or those made in the Previous Patent Applications. On the contrary, the intention is to cover all modifications, equivalents, and alternatives falling within the spirit and scope of the invention as defined by the appended claims.

DETAILED DESCRIPTION OF THE INVENTION

INCLUDING A BEST MODE

Nomenclature

1 Front Panel
2 Rear Pad/Panel
3 Adjustment Straps
**3*a*** Upper Adjustment Strap System
**3*b*** Lower Adjustment Strap System
4 Spine
5 Brow Channel
6 Flattened Space
7 Hook and Loop Strips
8 Slide
9 Circular Opening in Slide
10 Oblong Openings in Slide
11 Lower Ribs on the Rear Panel
12 Opening defined by Lower Ribs on the Rear Panel
13 Upper Ribs on the Rear Panel
14 Opening defined by Top Ribs on the Rear Panel
15 Padded Insert
**15*a*** Depressed Channels in Padded Insert
16 Opening or Depression in Padded Insert
17 Padded Insert
18 Channel defined by Padded Insert
19 Attachment Bands
20 Loop Fabric
21 Hook Strip
23 Channels in Exterior Surface of Front Panel
25 Fabric Sleeves
27 Removable Piece of Fabric Sleeve
28 Hook and Loop Fasteners
30 Vents defined by Spine
31 Hook and Loop Attachment Means
33 Areas on Spine to secure Hook and Loop Attachment Means
34 Padded Insert
35 Channel defined by Padded Insert
36 Extension of Padded Insert
40 Interior Surface of Headguard
41 Exterior Surface of Headguard
50 Central Pad
60 Header Target Location
61 Channels defining Header Target Location
100 Player
101 Head of Player
102 Top Portion of Player's Head
103 Forehead of Player
104 Sides of Player's Head

105 Crown of Player's Head
106 Temples of Player
107 Back of Player's Head
108 Brow of Player's Head
109 Neck of Player
110 Ponytail
200 Headguard
310 Right Lower Rib of Front Panel
312 Left Lower Rib of Front Panel
314 Right Upper Rib of Front Panel
316 Left Upper Rib of Front Panel
318 Front/Central Pad of Front Panel
320 Zero Areas on Front Panel
326 Seam Vent
328 Vent Pairs
332 Outside Flexing Area
334 Inside Flexing Area
336 Central Flexing Area
340 Attachment Points
342 Lower Right Slot
344 Lower Left Slot
346 Upper Right Slot
348 Upper Left Slot
350 Corresponding Slots Construction and Use The present invention is believed to be applicable to a number of different sports and is particularly suited to soccer where a player 100 intentionally strikes the ball (not shown) with the head 101. While the present invention is not so limited, an appreciation of various aspects of the invention will be gained through a discussion of the exemplary embodiments in connection with the examples provided below.

Figure 2:
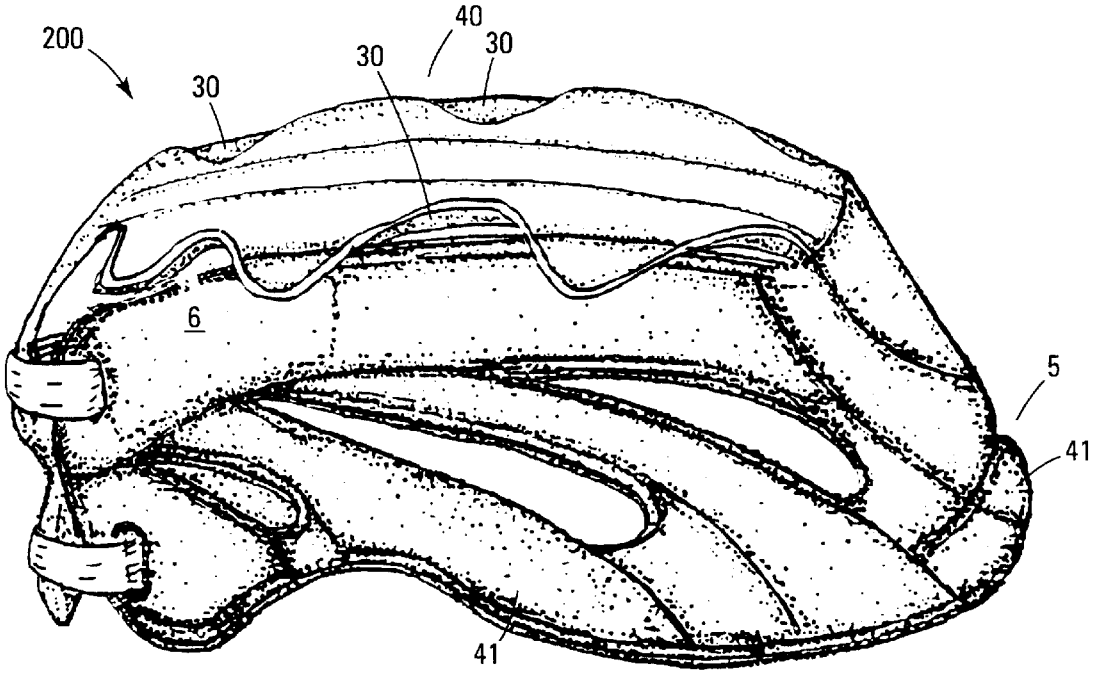
FIG. 2 is a perspective side view of an exemplary headguard in accordance with an embodiment with the spine.

FIG. 1 illustrates one exemplary headguard 200 in accordance with one embodiment of the invention. The headguard 200 generally may consist of a front panel 1, a rear panel 2, and two or more adjustment straps 3 made of elastic or other stretchable material. Another embodiment of the headguard 200 includes a spine 4 as illustrated in FIG. 2. The spine 4 covers the top portion 102 of the head 101 and connects the front 1 and rear 2 panels. The panels 1 and 2 are made of a shock-absorbing material such as foam which dissipates the force to the wearer's head 101 when struck by an object such as a ball (not shown). The foam of the headguard 200 is intended to protect the regions of the wearer's head 101 which may strike objects (not shown) during the course of play. The foam may have fabric (unnumbered) laminated to it on the interior 40 and/or exterior surfaces 41. In this embodiment, the panels 1 and 2 cover predominantly the forehead 103, the sides 104 from just below the crown 105 and down to the upper part of the temples 106, and the back 107 of the wearer's head 101 around the occipital bone (not shown). If the spine 4 is added as illustrated in FIG. 2, part or substantially all of the crown 105 of the head 101 may be covered. The addition of the spine 4 may be particularly suited for goalies and other players 100 who may need additional protection to the top of the head 102.

The padding (not shown) in the panels 1 and 2 should be sufficiently flexible so as to conform to unique head shapes and sizes. The position of the padding (not shown) may be suitably selected in consideration of the particular environment in which the headguard 200 is worn. For example, if the headguard 200 is used by a non-goalie, the padding (not shown) may be positioned to provide a relatively uniform exterior surface 41 over portions of a player's head 101 which generally come in contact with a soccer ball (not shown), thus allowing greater control of the ball (not shown). If a goalie uses the headguard 200, providing a uniform exterior surface 41 may not be as important since goalies rarely head the ball (not shown).

The thickness of the padding (not shown) may be suitably selected in consideration of the portion of the head 101 which the padding (not shown) is to cover as well as in consideration of the particular environment in which the headguard 200 is worn. For example, the thickness of the padding (not shown) may vary among the top, front, side, and back portions of the padding (not shown). Pad thickness around, for example, ⅜ to ⅝ inches, would be suitable for many applications. Suitable padding material includes solid and /or laminated foam, foam formed from plastic, for example, and foam laminated with fabric on the interior or exterior surfaces of the padding. If padding inserts 15 are added to the interior 40 of the headguard 200, the overall padding thickness can be increased from ⅜ to 1½ inches.

The Front and Rear Panels Without the Spine

Figure 3:
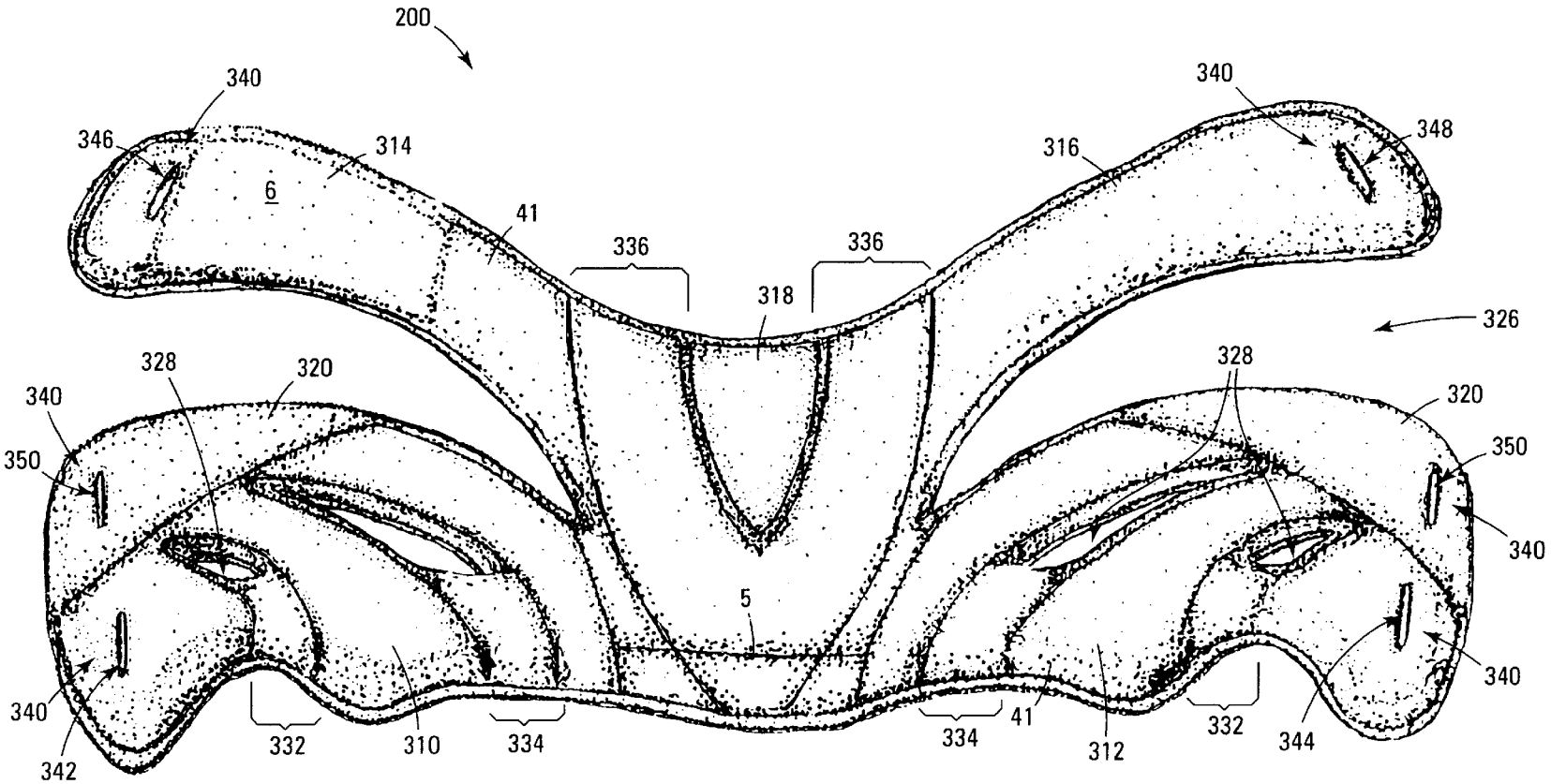
FIG. 3 is a view of the exterior surface of a front panel of an exemplary headguard before assembly.

As illustrated in FIGS. 1 and 3, the front panel 1 can be made from a flat piece of foam molded or cut into the proper shape which also can have fabric laminated to either or both sides. The front panel 1 has two lower ribs 310, 312 and two upper ribs 314, 316 emanating from respective sides of a center front pad 318 which typically covers at least part of a wearer's forehead 103.

On a portion of the exterior surface 41 of each lower rib 310 and 312 is a thinner area or zero area 320. For the zero areas thickness 320 a thickness for the padding of approximate ⅛ inch would be suitable. The interior surface 40 of each upper rib 314 and 316 may have a receiving depression (not shown) which corresponds to the size and shape of the zero areas 320 on the lower ribs 310 and 312. The depth of the receiving depressions (not shown) are preferably about equal to the thickness of the zero areas 320 on the lower ribs 310 and 312.

In assembly, the upper and lower ribs 310, 312, 314 and 316 are bent so that the zero areas 320 of the lower ribs 310 and 312 align with the receiving depressions (not shown) of the upper ribs 314 and 318. The left lower and upper ribs 312 and 316 attach to each other, and the right lower and upper ribs 310 and 314 attach to each other. By bending the ribs 310, 312, 314 and 316 in this fashion, the center front pad 318 is typically pushed outward, and the front panel 1 takes on a cupped shape that more closely conforms to the shape of the human head 101. The thickness of the padding (not shown) at points where the zero areas 320 and the receiving depressions (not shown) overlap is preferably about equal to the thickness of the padding in the thicker portions of the front panel 1.

In order to maintain the cupped shape of the front panel 1, the upper and lower ribs 310, 312, 314 and 316 on each side may be permanently attached to each other at the overlap of the zero areas 320 and receiving depressions (not shown) by stitching, or they may be attached by hook and loop fasteners (not shown). The hook and loop fasteners (not shown) may be located on the zero areas 320 and receiving depressions (not shown) for disposal between these structures. Use of hook and loop fasteners (not shown) permits easy disassembly of the front panel 1.

When assembled, the front panel 1 typically defines three vents on either side of the center front pad 318. A aperture or seam vent 326 is created on each side between the upper and lower ribs 310, 312, 314 and 316 of each side when they are bent and attached. In addition, two vents 328 are molded or cut into each of the lower ribs 310 and 312.

To aid in flexing the pads (not shown) to conform to the head 101, the channels (unnumbered) may be molded into the exterior surface 41 at different locations to create flexing areas 332, 334 and 336. One or more channels (unnumbered) may, for example, be disposed between each of the upper ribs 314 and 316 and the central pad 318 for increasing flexing between these ribs 314 and 316 and the central pad 318.

The flexing areas 332, 334 and 336 function as hinges by increasing the ability of the foam to flex and curve in order to conform to the shape of the head 101.

The padding (not shown) is thinner at the base of the channels (unnumbered) thus increasing the flexibility of the foam generally in the direction opposite the direction of the channels (unnumbered).

The channels (unnumbered) allow the padding (not shown) to bend along the channels (unnumbered). As noted above, a flexing area 332, 334 and 336 may consist of one or more channels (unnumbered). If there is more than one, the channels (unnumbered) run generally parallel to each other (although non-parallel channels from different flexing areas may intersect). While flexing areas 332, 334 and 336 with one to four channels (unnumbered) are disclosed, the invention extends to cover flexing areas 332, 334 and 336 with more channels (unnumbered).

The channels (unnumbered) of the flexing areas 332, 334 and 336 are molded into the exterior surface 41 of the front panel 1 at points where the front panel 1 desirably curves most severely in order to conform tot he shape of the head 101. For example, the flexing areas 334 are located at the portion of the front panel 1 which would rest on the part of the head 101 that forms the transition from the forehead 103 to the side of the head 104. The channels (unnumbered) of the flexing areas 332 and 334 typically run at angles to the bottom or top edges (unnumbered) of the assembled front panel 1 between 45 and 90 degrees, thereby increasing the ability of the front panel 1 to wrap around the head 101. The channels (unnumbered) in flexing areas 332 and 334 may run approximately along the same line as and along side the vents 326 and 328 in the front panel 1 as shown. Another flexing area 336 may surround the frontal bone (not shown), which on some players 100 protrudes outward.

The front panel 1 includes four attachment points 340 which serve as locations where the adjustment straps 3 may be attached to the front panel 1. The attachment points 340 are typically areas where slots 342, 344, 346 and 348 are molded into the foam as shown best in FIG. 3. Alternatively, the attachment points 340 may be small depressed areas suitable for sewing attachment rings (not shown).

The slots 342, 344, 346 and 348 are openings molded or cut through the entire thickness of the padding through which the adjustment straps 3 pass. The slots 342, 344, 346 and 348 may be of varying sizes but must be of a size to permit an adjustment strap 3 to pass through. A slot length of ⅝ to ¾ inches, for example, may be suitable.

To form the assembled front panel 1, the upper slots 346 and 348 may overlap with corresponding slots 350 located in the zero areas 320 of lower ribs 310 and 312 when the zero areas 320 and the receiving depressions (not shown) are bent together. When the upper and lower ribs 310, 312, 314 and 316 are jointed together in assembly, slots 346 and 348 each along with a corresponding slot 350 to form one set of upper slots on each side of the front panel 1.

A brow channel 5, located above the brow of the head 108 and below the frontal bone (not shown), is provided in the front panel 1. The brow channel 5 is a depression in the front panel 1 that may run parallel to the brow of the wearer 108 located on the front panel 1 in the area where the headguard 200 covers the head 101 between the brow 108 and the frontal bone (not shown). The brow channel 5 permits the front portion (unnumbered) of the headguard 200 to conform to the depression which often exists in a wearer's head 101 in the area between the brow 108 and the frontal bone (not shown). This conformity improves the retention of the headguard 200 to the head 101 of the wearer.

Space 6 can be provided for the application of symbols such as logos or lettering to the exterior surface 41 of the headguard 200. Given the nature of the foam molding process, the headguard 200 permits the easy creation of such symbols. For example, a flattened area of space 6 on the upper ribs 314 and/or 316 of the front panel 1 can receive the imprint of a symbol or written material. In addition, symbols could be molded into the foam during the molding process. If the flattened space 6 on the upper rib 314 and/or 316 is located to the rear of the upper rib 314 and/or 316, it could be located approximately at the zero area 320 of the lower rib 310 and 312, when the corresponding upper and lower ribs 310, 314 and 312, 316 are brought together during assembly. The combined thickness of the zero area 320 and the flattened space 6 on the upper rib 314 and/or 316 need not be significantly lessen the overall thickness of the foam.

Figure 4:
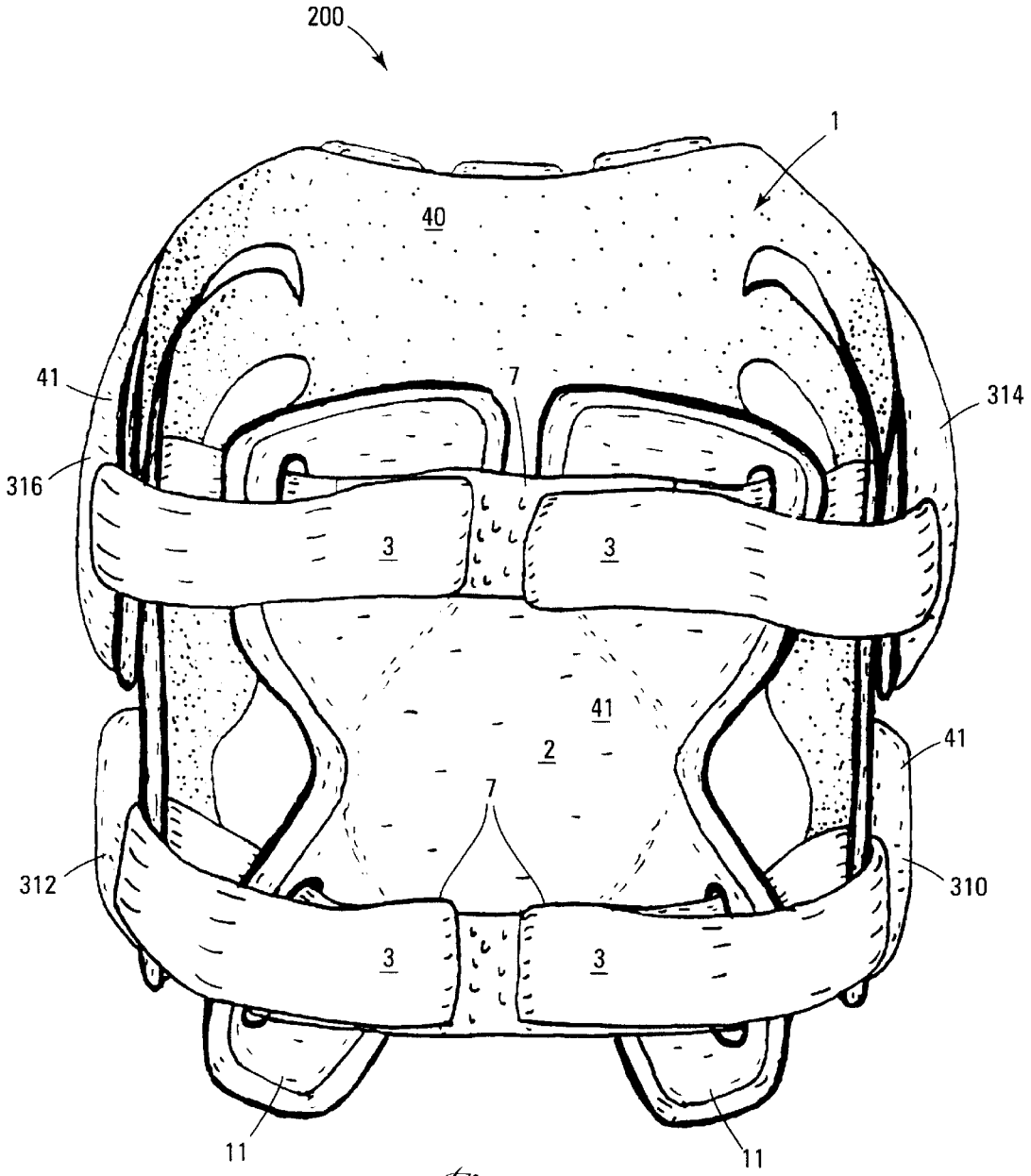
FIG. 4 is a back view of an exemplary headguard with hook and loop attachment in the back.
Figure 5:
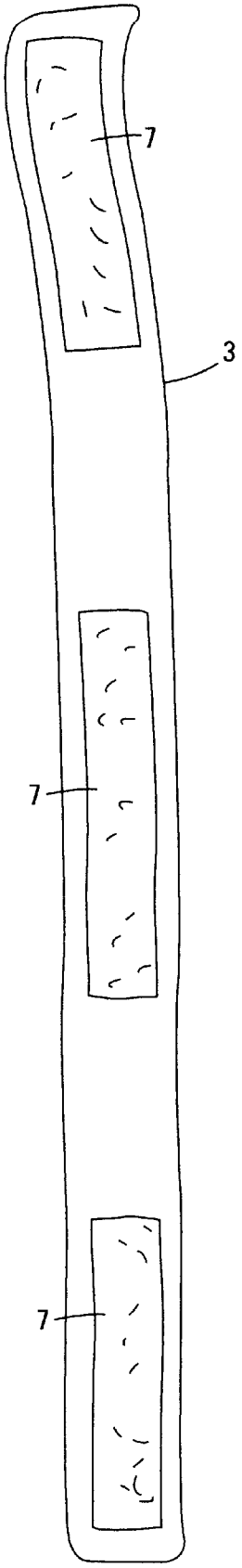
FIG. 5 is a top view of an exemplary adjustment strap.

As shown in FIG. 4, hook and loop strips 7 can be sewn onto the adjustment straps 3 with the hook and loop fastening at the back of the back panel 2. The configuration of the hook and loop strips 7 on the adjustment strap 3 is shown in FIG. 5. This positioning of the hook and loop fasteners 7 increases the adjustibility of the headguard 200 and reduces the number of hook and loop strips 7 that have to be attached to the adjustment strap 3.

Figure 6:
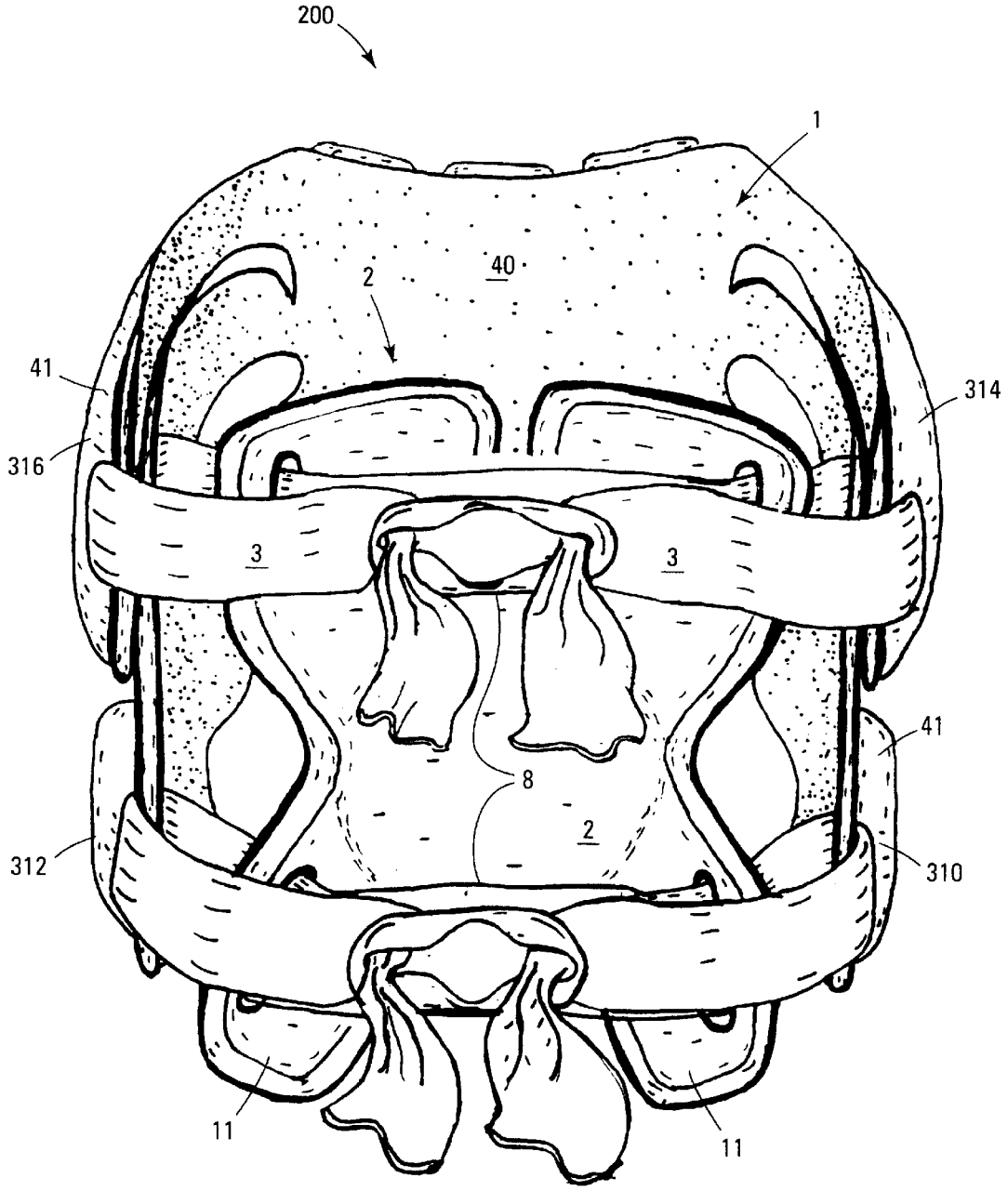
FIG. 6 is a back view of an exemplary headguard with a lockable slide.
Figure 7:
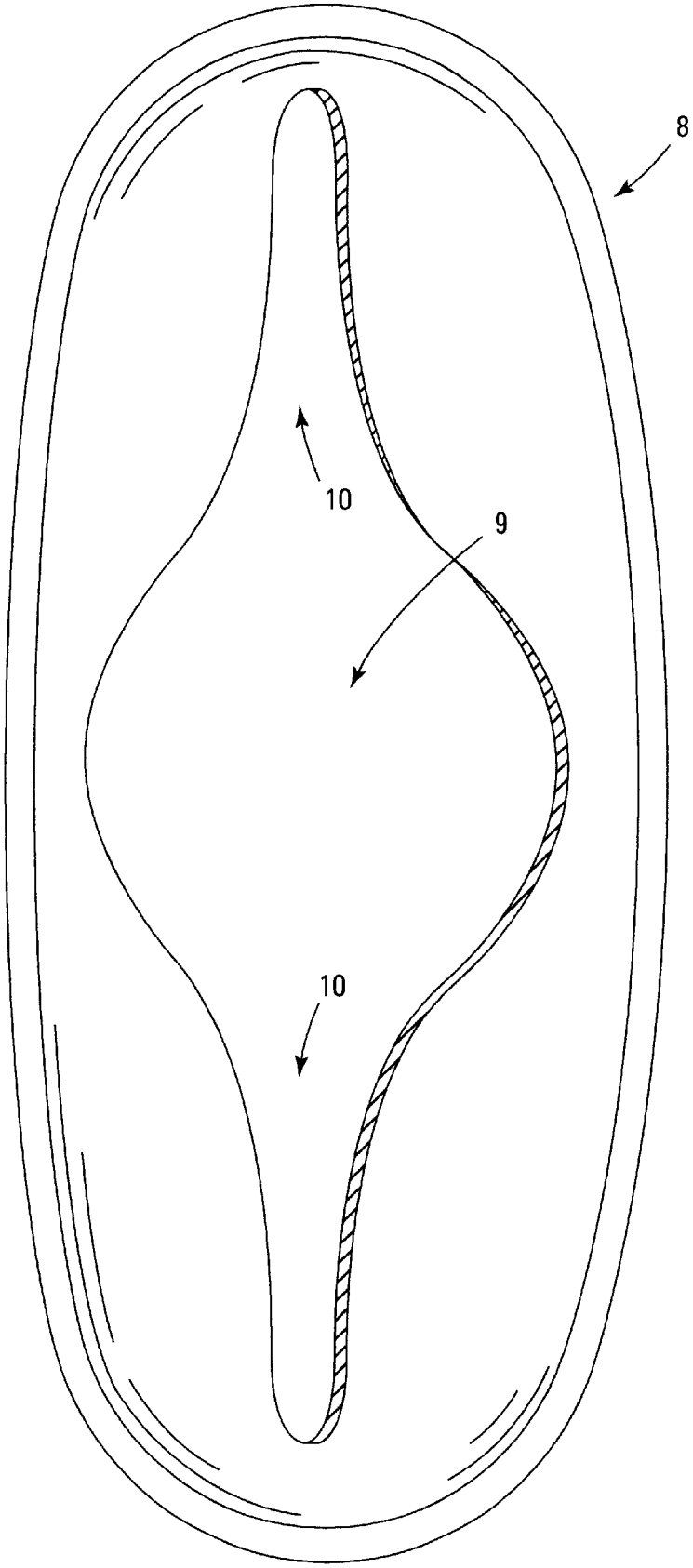
FIG. 7 is a view of the exterior surface of an embodiment of a lockable slide.

A shown in FIGS. 6 and 7, attachment straps 3 can be constructed from a stretchable fabric with a lockable slide device 8 used to adjust the tension of the straps 3. The ends of the straps 3 would be pulled through the circular opening 9 in the middle of the slide 8. When the proper size is reached, the straps 3 would be slid sideways into the narrow oblong openings 10 on the lockable slide 8. A small amount of tension on the straps 3 would wedge the fabric tightly into the narrow oblong openings 10, thereby preventing slipping of the straps 3.

Figure 8:
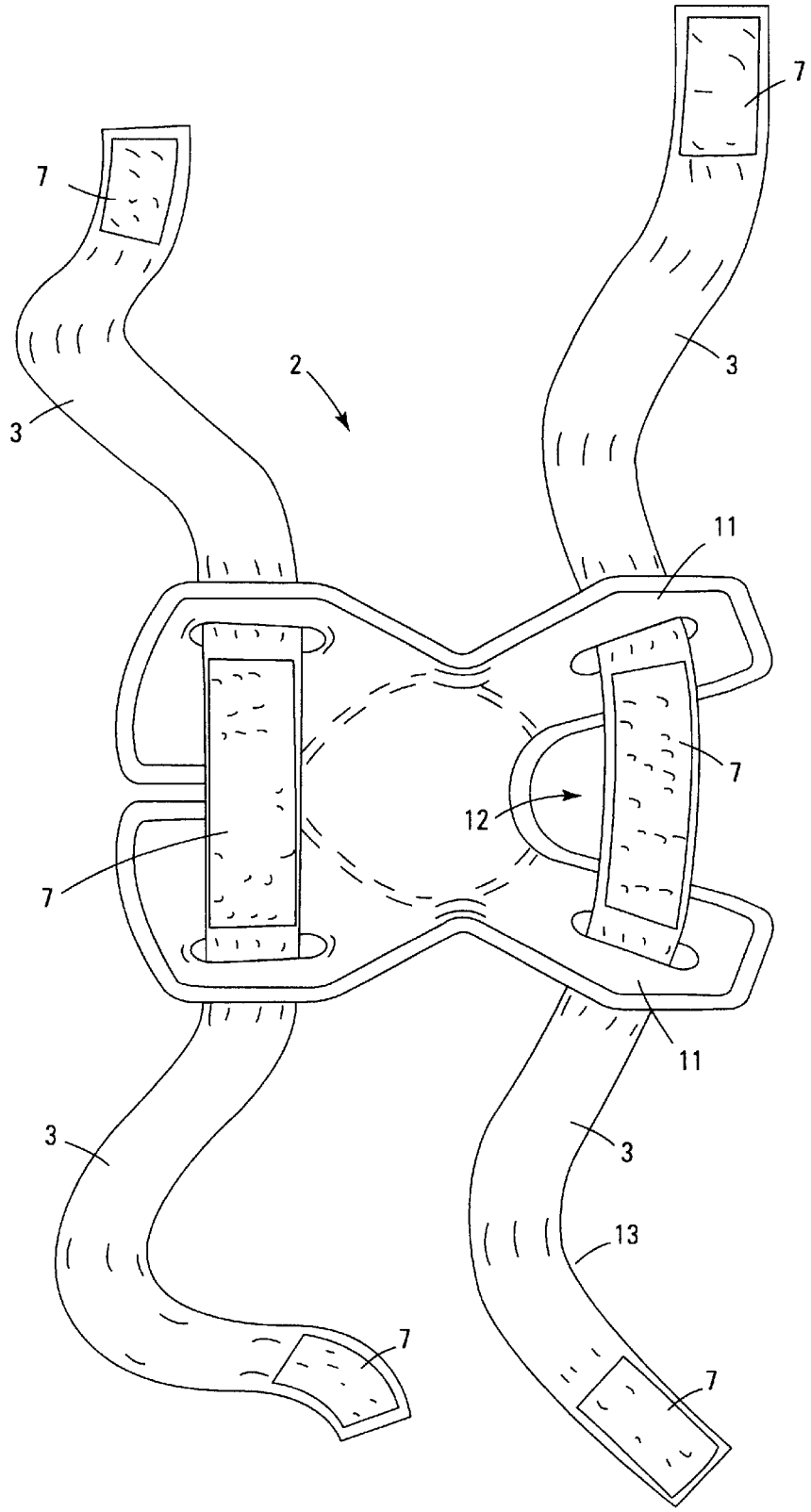
FIG. 8 is a view of the exterior surface of an embodiment of a rear panel with extended lower ribs.

As illustrated in FIG. 8, the two lower ribs 11 of the rear panel 2 can be lengthened to increase the size of the opening 12 between the two lower ribs 11 and above the lower strap 3, thereby making it easier to insert a ponytail 110. Lengthening of the two lower ribs 11 also lowers the area covered by the back panel 2 to provide protection for the upper portion of the neck 109. This creates greater coverage of padding (not shown) on the backside of the head 107. Finally, because of the curvature of the back of the head 107 toward the neck 109, it positions the lower strap 3 further forward of the occipital bone (not shown) thereby improving retention.

Figure 9:
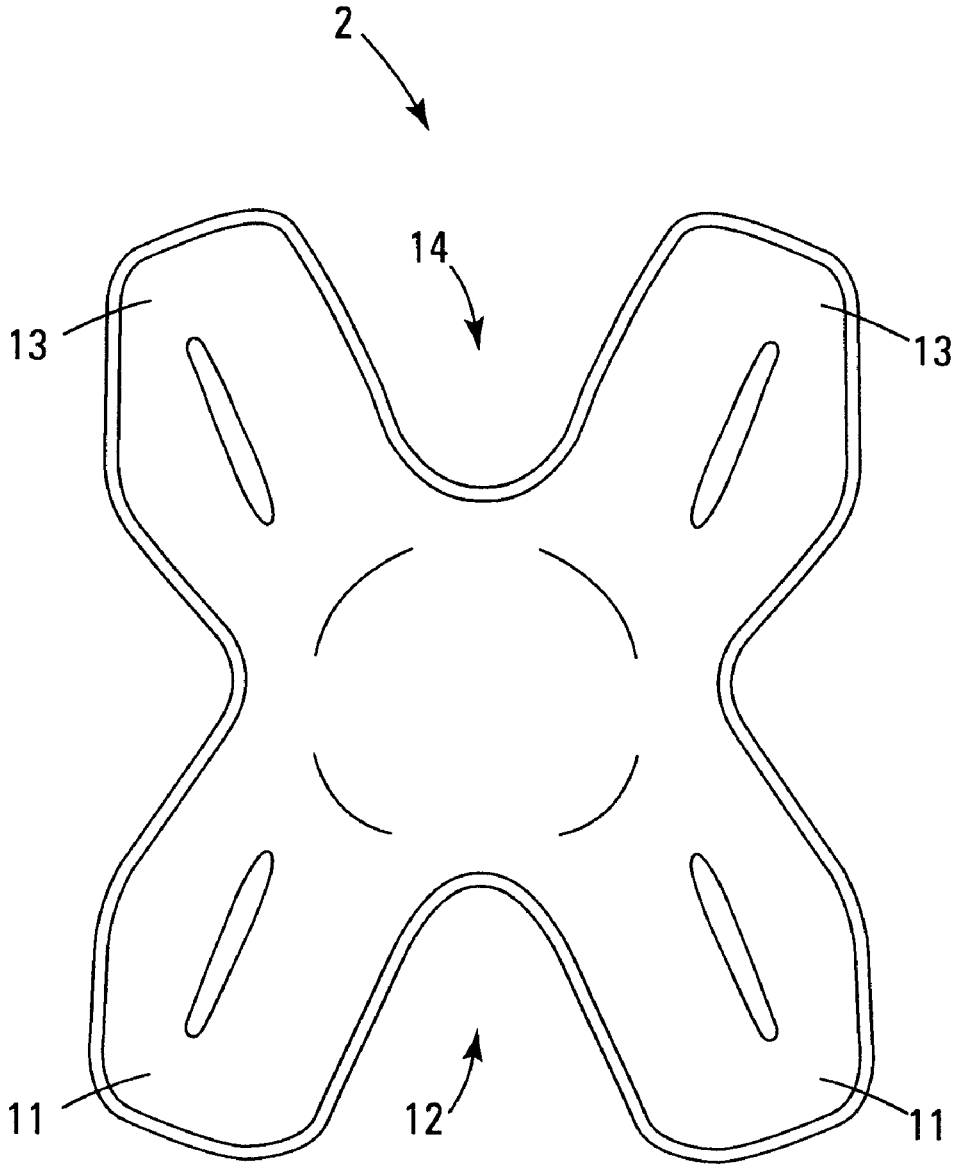
FIG. 9 is a view of the exterior surface of an embodiment of a rear panel with matching openings on the top and bottom.

As shown in FIG. 9, back panel 2 can be configured with two openings 12 and 14 between the lower and upper ribs 11 and 13 of the rear panel 2 respectively. This permits a player 100 with a ponytail 110 to run the ponytail 110 either out the top 14 or the lower 12 opening of the rear panel 2.

Figure 10:
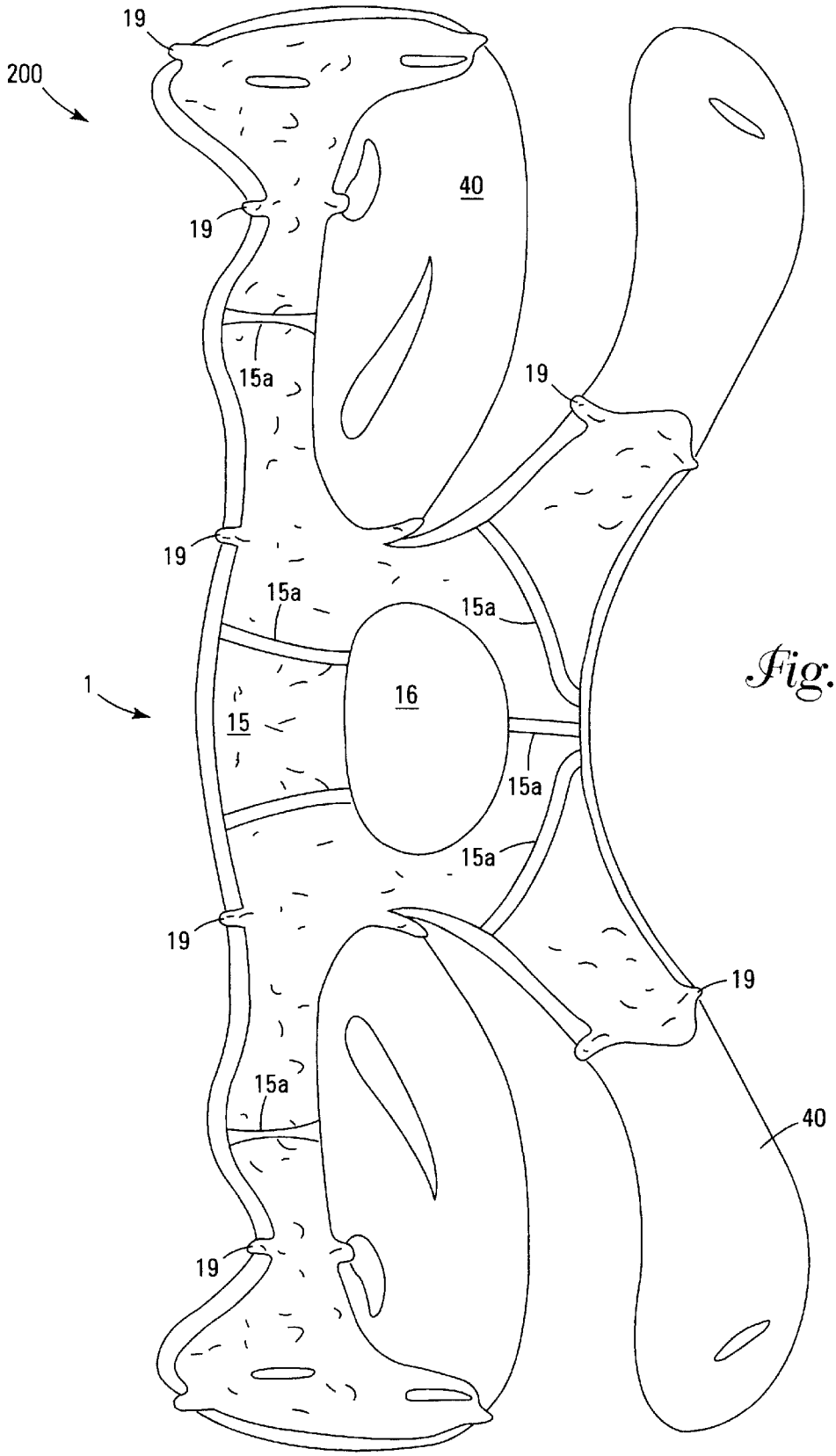
FIG. 10 is a view of the interior surface of an embodiment of the front panel with a padded insert before assembly.

Padded inserts 15 may be attached to the interior 40 of the headguard 200. As shown in FIG. 10, the padded inserts 15 may be one piece. Depressed channels 15*a* may be provided in the padded insert 15 to increase ventilation. An opening or depression 16 in the padded insert 15 covering the frontal bone (not shown) may be provided. The opening or depression 16 in the padded insert 15 could be located at the strike pad (the area of the headguard 200 covering the forehead 103 intended for heading the ball) and could accept the protrusion created by the frontal bone (not shown). By raising the areas surrounding the protrusion created by the frontal bone (not shown), the strike pad should be flattened, creating a larger, flatter area, making it easier to head the ball (not shown) off the forehead 103. In addition more air space for cooling the head 101 is created. Finally, retention should be increased because the opening 16 creates a ridge (unnumbered) around the frontal bone (not shown). This ridge (unnumbered) makes it more difficult for the headguard 200 to come off the head 101.

Figure 11:
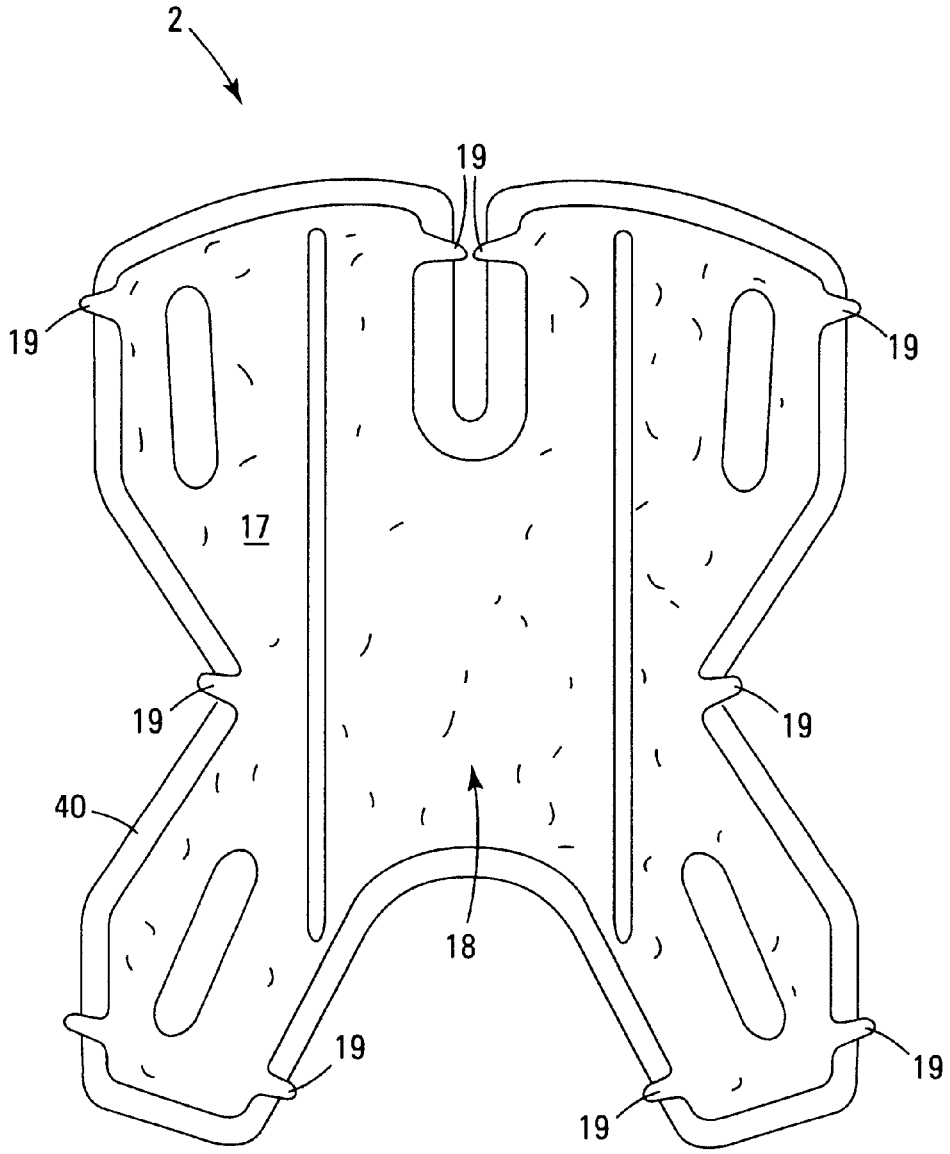
FIG. 11 is an interior view of an embodiment of the rear panel with a padded insert.
Figure 12:
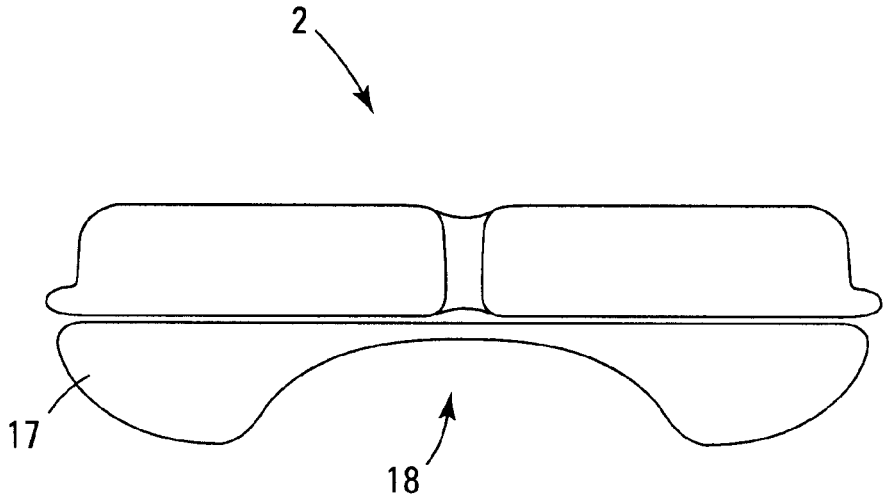
FIG. 12 is a profile view of an embodiment of the rear panel from the top with a padded insert.

Similarly on the interior 40 of the back panel 2, a one-piece padded insert 17 could be included. The padded insert 17, shown in FIG. 11, includes a flattened area running vertically down the middle of the back panel 2. This channel 18 provides greater room for a ponytail 110. A profile view of the top side of the rear panel 2 is disclosed in FIG. 12.

The padded inserts 15 and 17 could be, for example, made of open-cell foam covered with fabric. The fabric could be loop fabric. Alternatively the fabric could be a disposable sterile fabric. The disposable sterile fabric could be used for temporarily covering wounds to the head 101 when a player 100 is injured.

Figure 13:
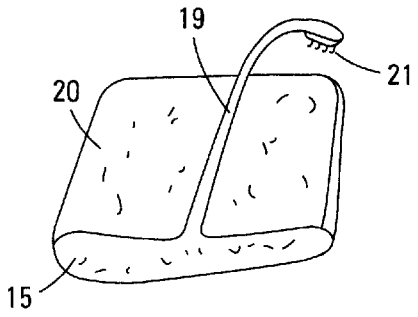
FIG. 13 is a cross-sectional perspective view of a padded insert with an embodiment of an attachment band.
Figure 14:
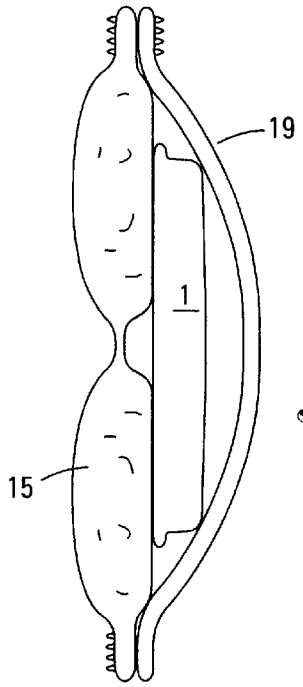
FIG. 14 is a cross-sectional cut-away view of a section of a padded insert with an embodiment of an attachment band.
Figure 15:
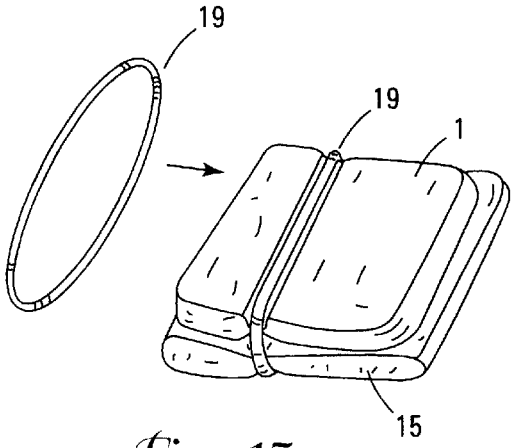
FIG. 15 is a perspective view of a section of a padded insert with an embodiment of an attachment band.
Figure 16:
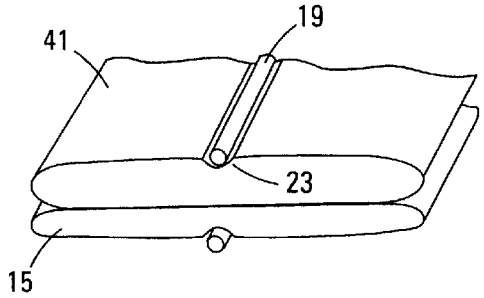
FIG. 16 is a cross-sectional perspective cut-away view of a section of a padded insert with an embodiment of an attachment band.

As shown in FIGS. 13 through 16, the padded inserts 15 and 17 may be attached to the headguard 200 by attachment bands 19. Attachment bands 19 can be constructed as part of the padded insert 15 and 17. The attachment bands 19 are used to attach the padded inserts 15 and 17 to the corresponding panel 1 and 2. For example, if the padded insert 15 is laminated with loop fabric 20, extra bands 19 can be cut into the fabric 20 and hook strips 21 can be sewn or otherwise attached to the ends (unnumbered) of the attachment bands 19 as illustrated in FIG. 13. Once the attachment band 19 is looped over the front panel 1, the hook strip 21 is attached to the same padded insert 15. In another embodiment, the attachment bands 19 can be sewn onto the insert 15 as shown in FIG. 14. Finally, attachment bands 19 can be loops of elastic material as shown in FIG. 15. The attachment bands 19 can be looped over a portion of the panel 1 with the elastic tightening to hold the padded insert 15 in position against the panel 1. The attachment bands 19 can fit within channels 23 in the exterior surface 41 of the panel 1 as shown in FIG. 16 to prevent the elastic and correspondingly the padded insert 15 from sliding out of position.

Figure 17:
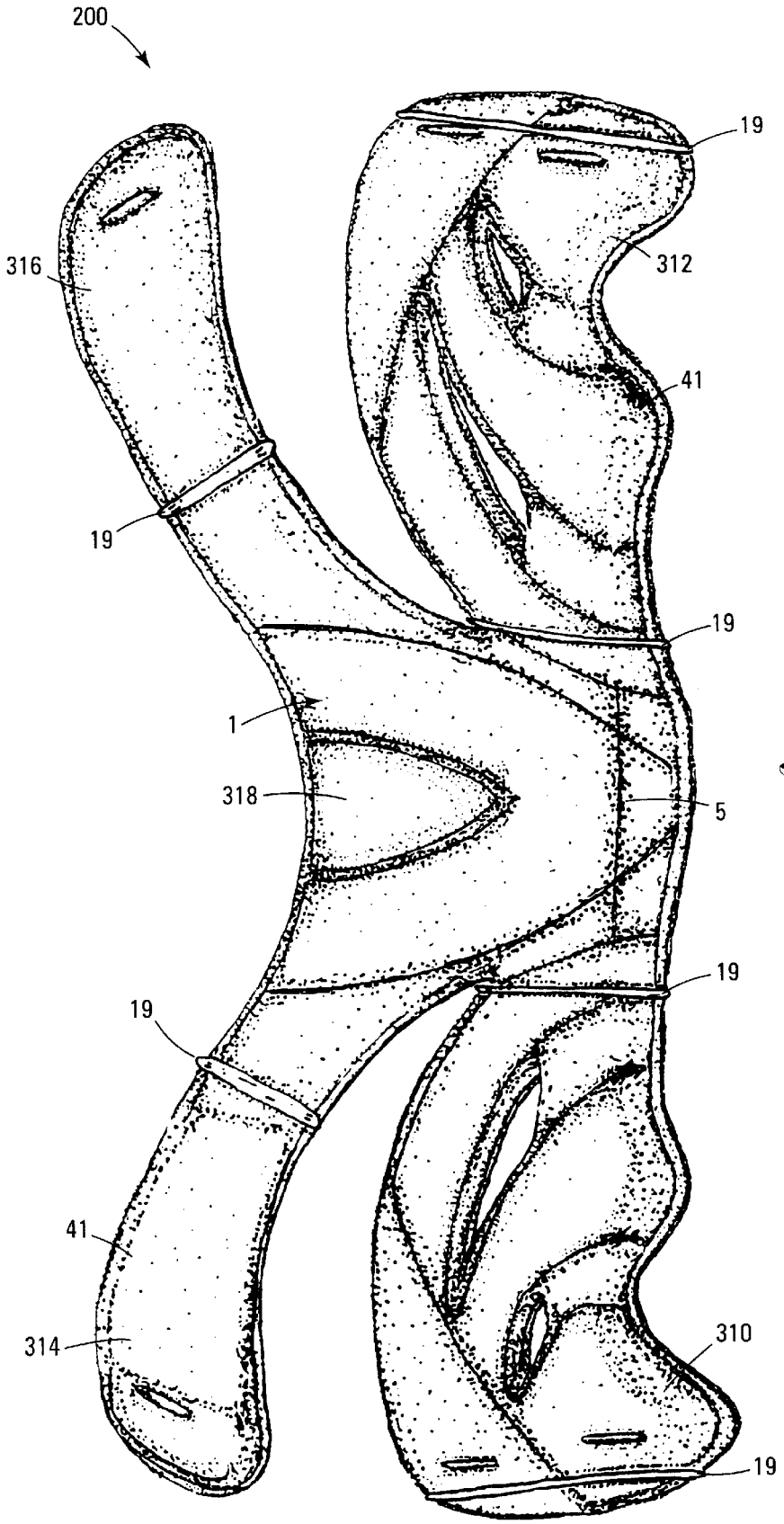
FIG. 17 is an exterior view of an embodiment of the front panel with attachment bands.
Figure 18:
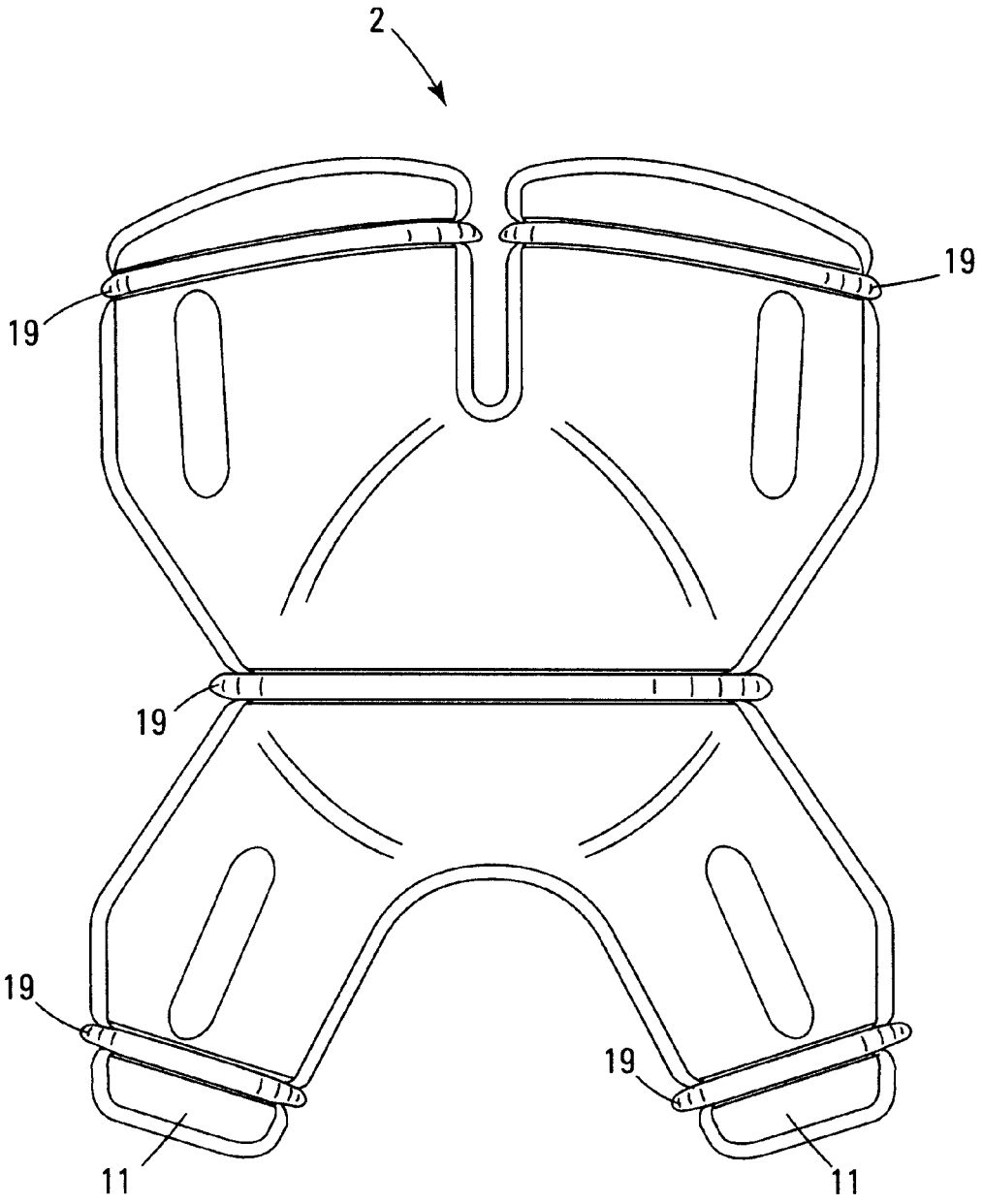
FIG. 18 is an exterior view of an embodiment of the rear panel with attachment bands.

In FIG. 17, the exterior 41 of the front panel 1 is shown with the attachment bands 19 mounted at potential locations. The rear panel 2 is shown in FIG. 18 with the attachment bands 19 mounted at potential locations.

Fabric sleeves 25 can be provided into which a portion or all of the front and rear panels 1 and 2 can be inserted. The fabric sleeves 25 could encase the interior and exterior surfaces 40 and 41 of the front and rear panels 1 and 2 in fabric. The fabric sleeves 25 could serve several purposes. The interior (unnumbered) of the fabric sleeves 25 could have padding (not shown) attached to it. This foam could serve the same purposes and be located in the same places as the padded inserts 15 described above. In addition, symbols such as lettering, numbers, or logos could be attached to the exterior surface (unnumbered) of the sleeves 25, allowing players 100 or teams (not shown) to choose from a variety of color or fabric types. Like the inserts 15, the sleeves 25 could be removed from the panels 1 and 2 for cleaning. Finally, other materials such as foam or plastic could be fastened by sewing or adhesive to the exterior surface (unnumbered) of the fabric sleeves 25.

Figure 19:
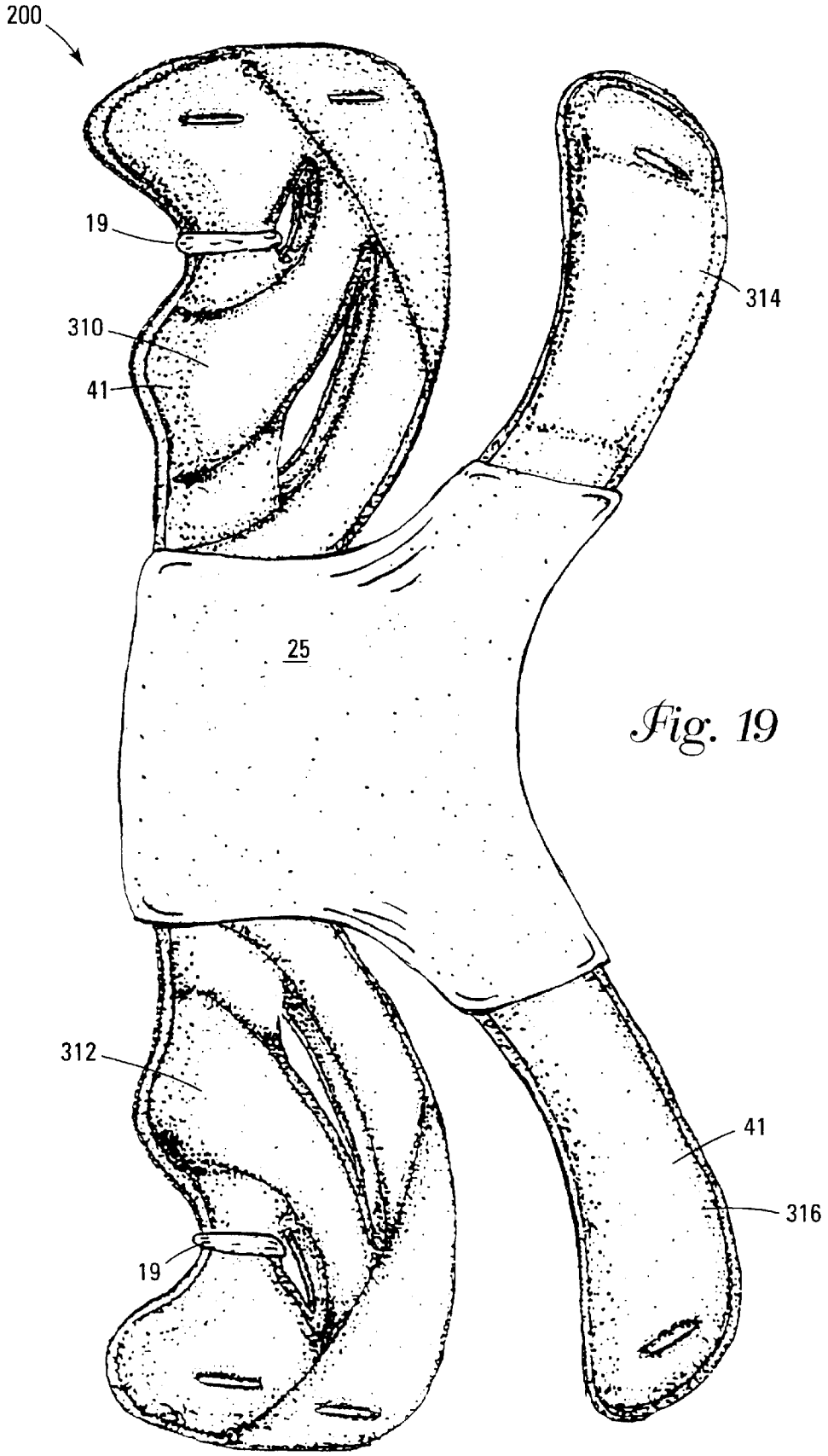
FIG. 19 is an exterior view of an embodiment of the front panel with a sleeve covering the strike pad.
Figure 20:
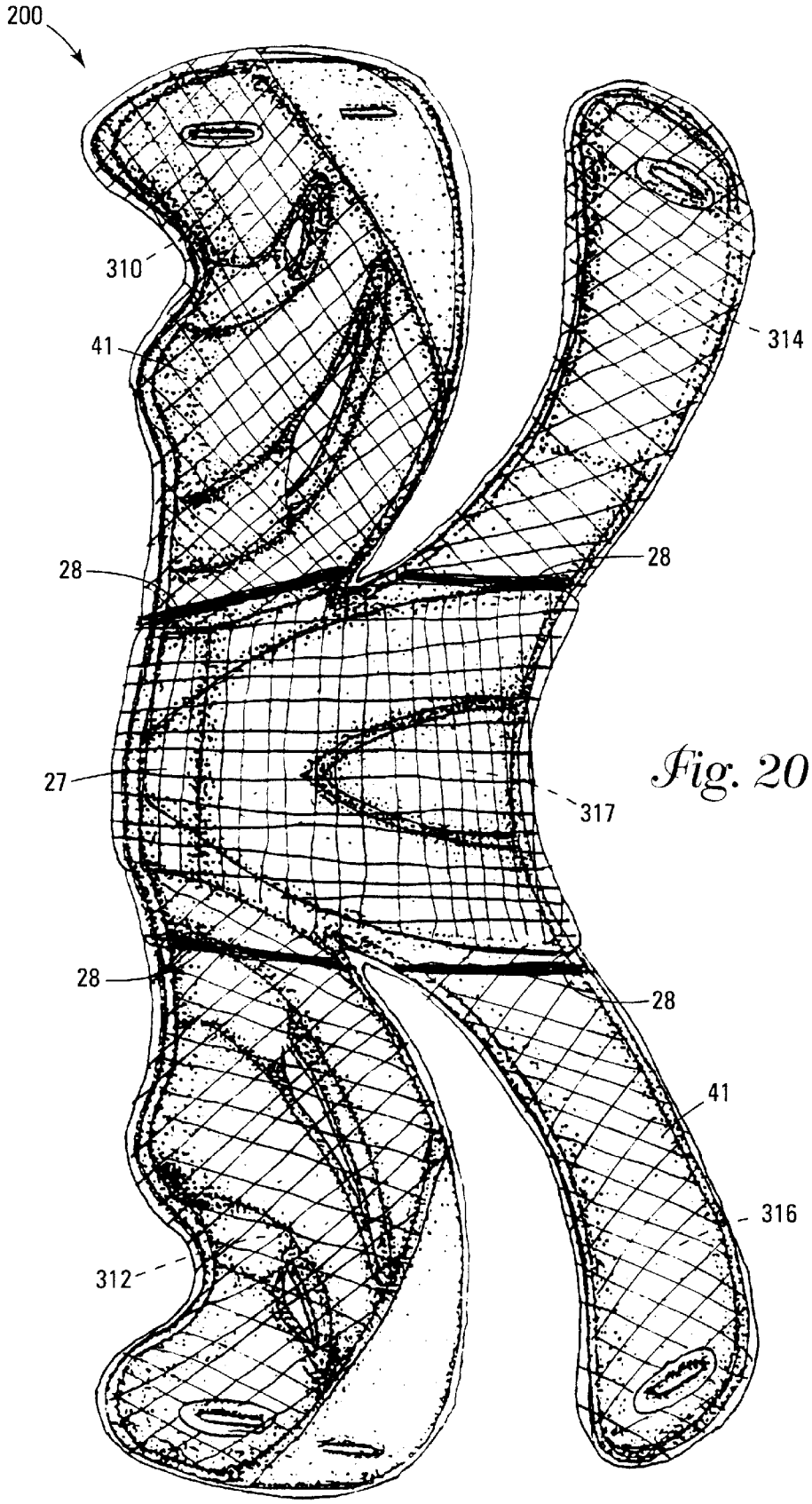
FIG. 20 is an exterior view of an embodiment of the front panel with a mesh sleeve covering the panel.
Figure 21:
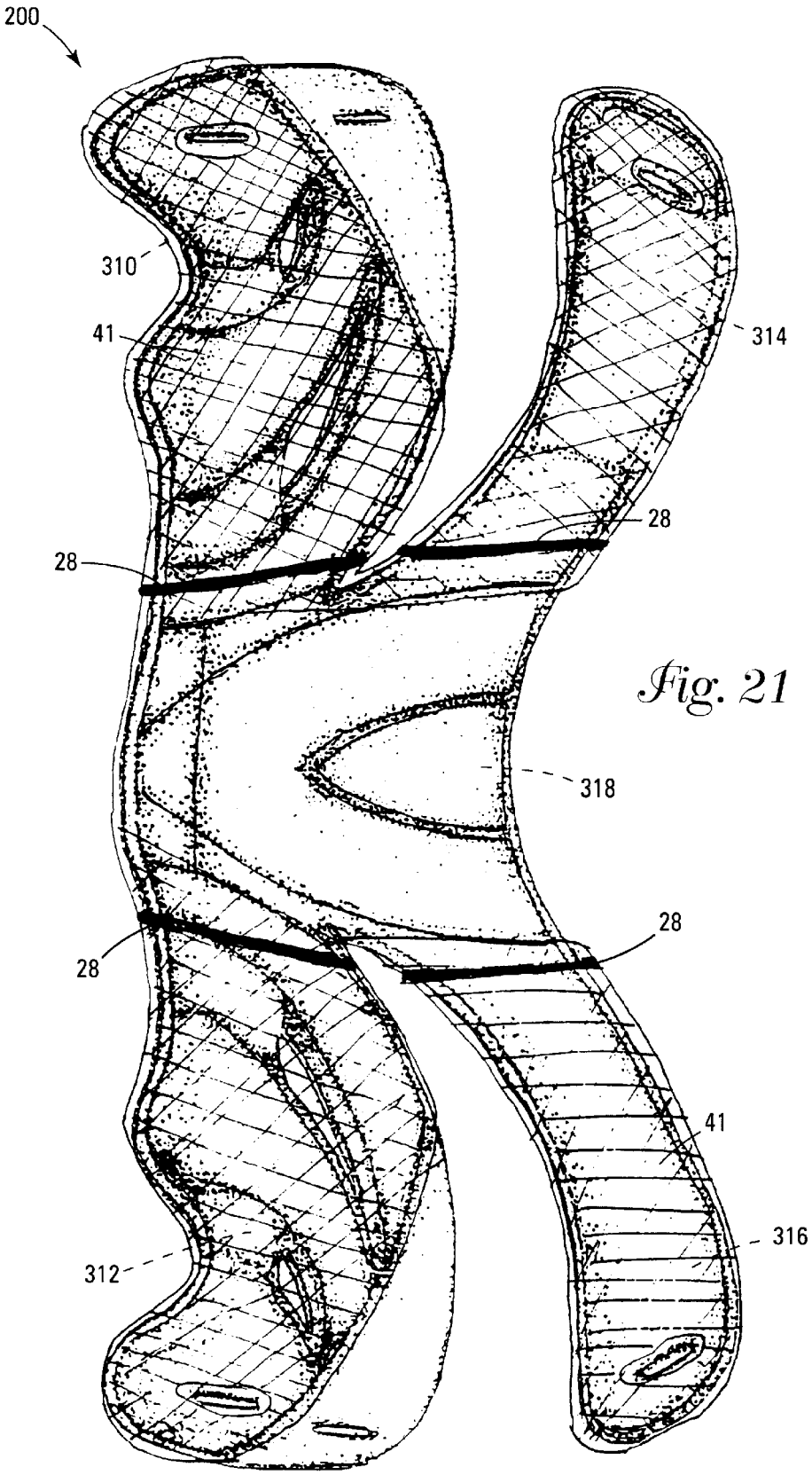
FIG. 21 is an exterior view of an embodiment of the front panel with a piece covering the strike pad removed.
Figure 22:
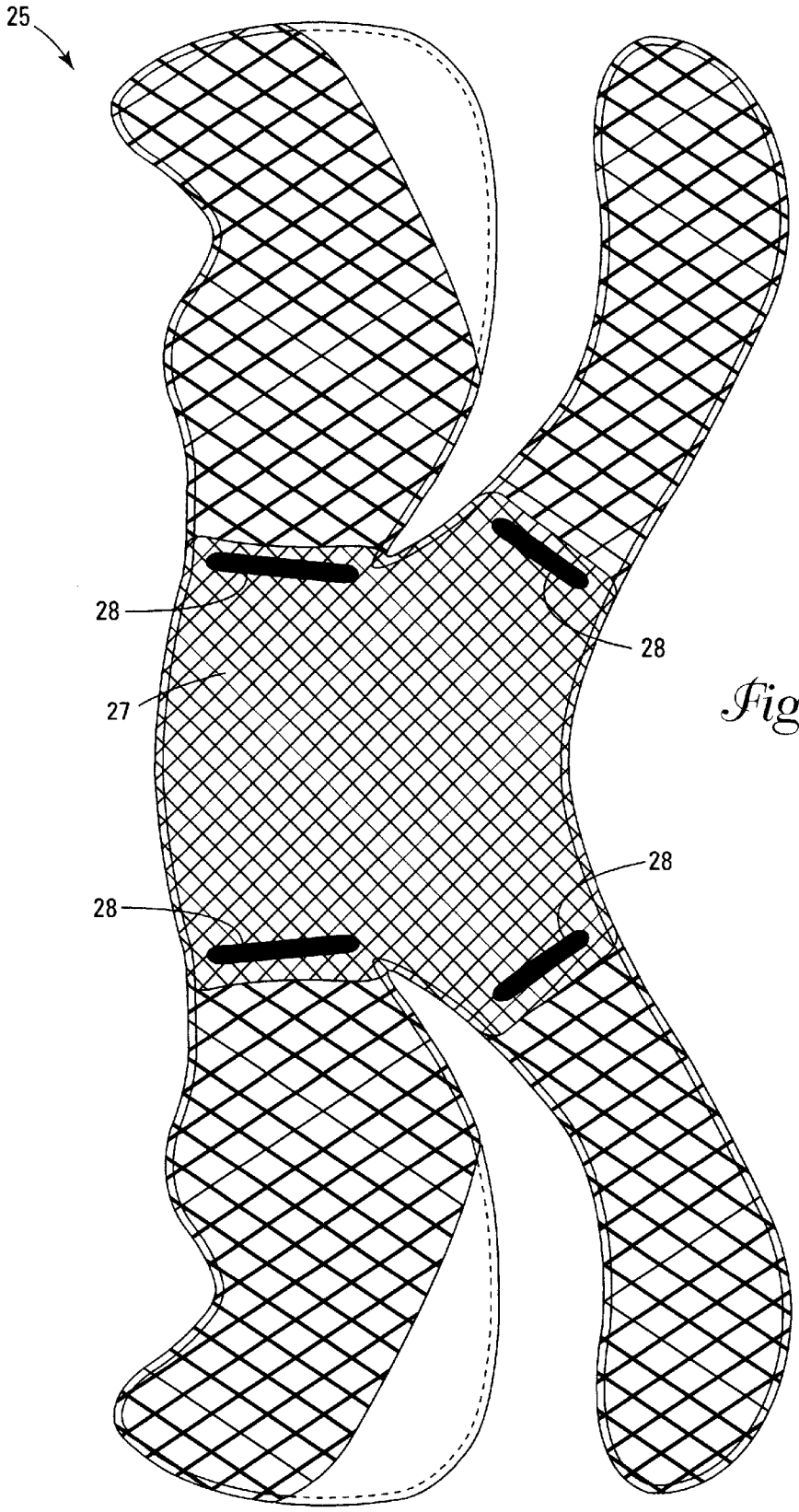
FIG. 22 is an internal view of an embodiment of the sleeve without the front panel inserted into it.
Figure 23:
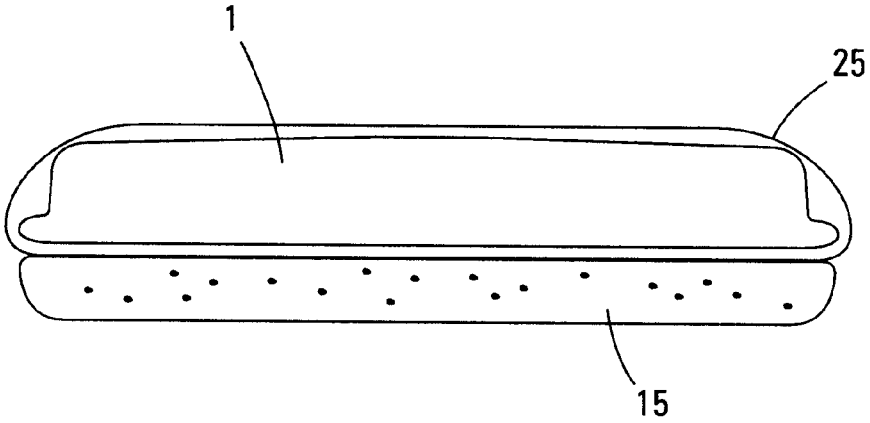
FIG. 23 is a cross-sectional cut-away side view of the panel with the fabric sleeve covering the interior and exterior of the panel.

The fabric sleeves 25 could take several forms. One embodiment, shown in FIG. 19, has a sleeve 25 covering the central portion (unnumbered) of the front panel 1. Another embodiment, shown in FIG. 20, has a sleeve 26 covering the entire front panel 1. This second embodiment could have a removable piece 27 which could be fastened in place with hook and loop fasteners 28. In FIG. 21, an embodiment is shown with the removable piece 27 covering the strike pad removed. A removable piece 27 would enable easier insertion of the panels 1 and 2 into the sleeves 25. Stretchable fabric could also ease the insertion of the panels 1 and 2 into sleeve 25. A fabric sleeve 25 without the front panel 1 inserted is shown in FIG. 22. In FIG. 23, a cross section of the exterior fabric sleeve 25 covering the front panel 1 is shown. The exterior fabric sleeve 25 can be sewn or attached to padded inserts 15 located on the interior 40 of the headguard 200.

The Model With the Spine

Figure 24:
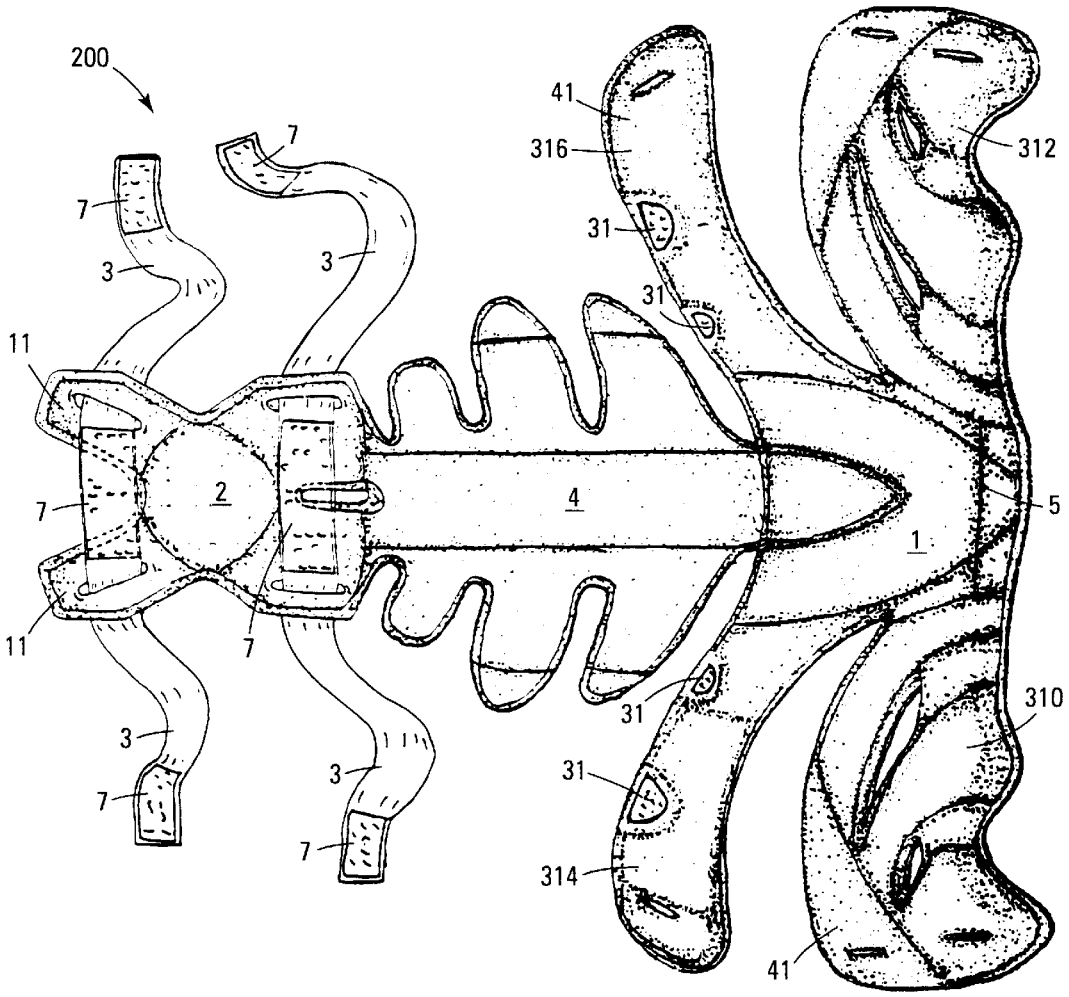
FIG. 24 is an external view of an unassembled exemplary headguard in accordance with an embodiment with a spine.
Figure 25:
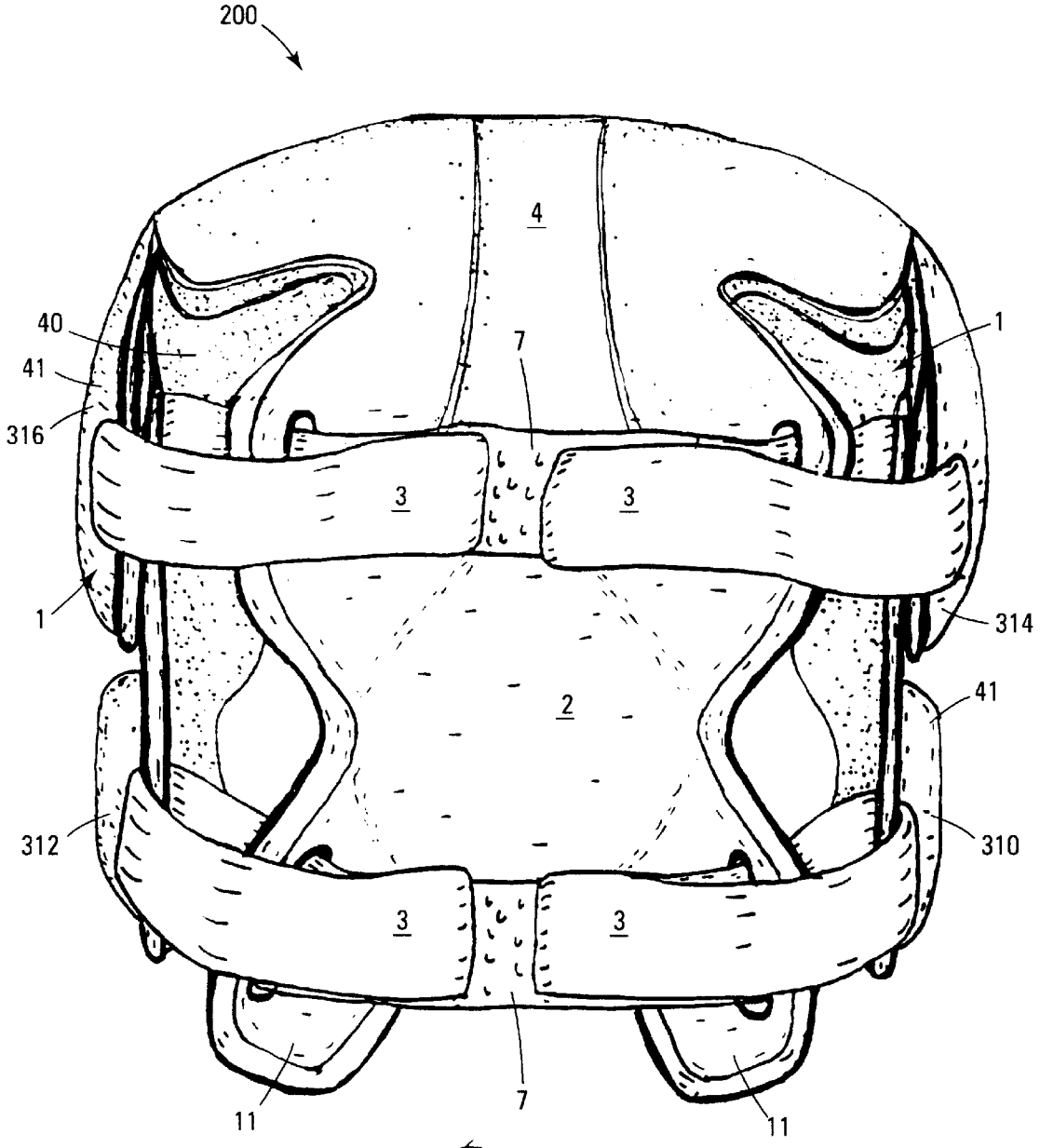
FIG. 25 is a rear view of an exemplary headguard with the spine.

As shown in FIG. 2, the headgear 200 may include a spine 4 connecting the front panel 1 to the rear panel 2 over the top of the head 102. FIG. 2 shows a side view of the embodiment with a spine 4 attaching the front and rear panels 1 and 2. In this embodiment the spine 4 covers a substantial portion of the top of the head 102, although vents 30 are created to permit air to circulate. FIG. 24 shows the entire headgear 200 lying flat before assembly. The spine 4 is typically created along with the front and rear panels 1 and 2 during the molding process in the form of a single flat pad. In FIG. 25 a rear view of this embodiment is shown.

To improve conformity of the headguard 200 to the head 101 and to maintain the three-dimensional shape of the headguard 200, the spine 4 could be attached to the side portions 314 and 316 of the headguard 200 with hook and loop or other attachment means 31. The hook portion of the hook and loop fasteners 31 could be located on the top (unnumbered) of the upper ribs 314 and 316 as shown in FIG. 24. The loop portion of the hook and loop fasteners 31 could be located on the interior 40 of the headguard 200 at points 33 shown in FIG. 26 either as individual patches or as part of a fabric covering 25 on the interior 40 of the headguard 200.

After assembly, the spine 4 runs from the top of the front panel 1 over the crown of the head 105 to the top of the rear panel 2. The spine 4 can provide additional protection to the head 101 and may assist in preventing slippage of the headguard 200 over the brow 108 or down the neck 109.

Figure 26:
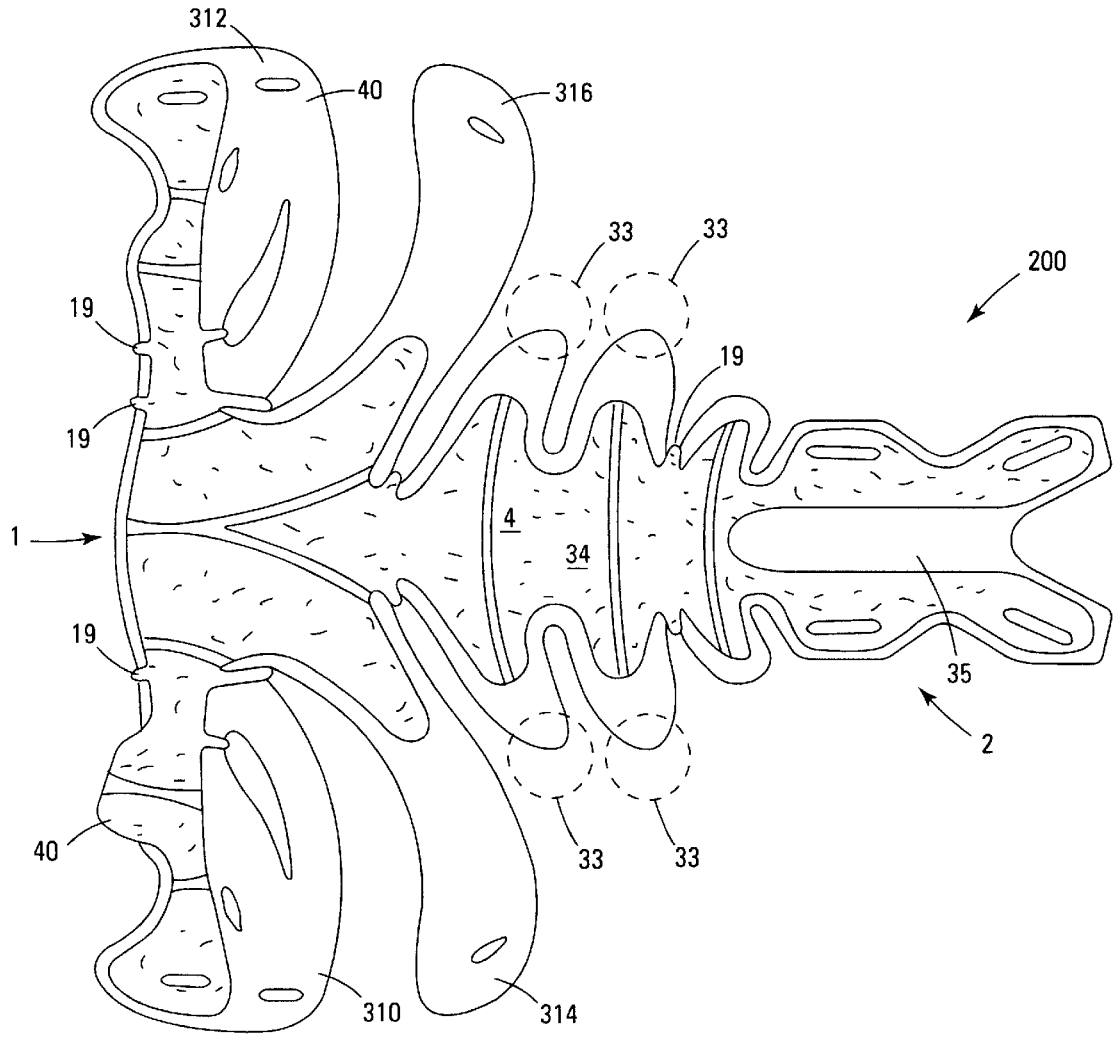
FIG. 26 is an interior view of an unassembled exemplary headguard in accordance with an embodiment with a spine.
Figure 27:
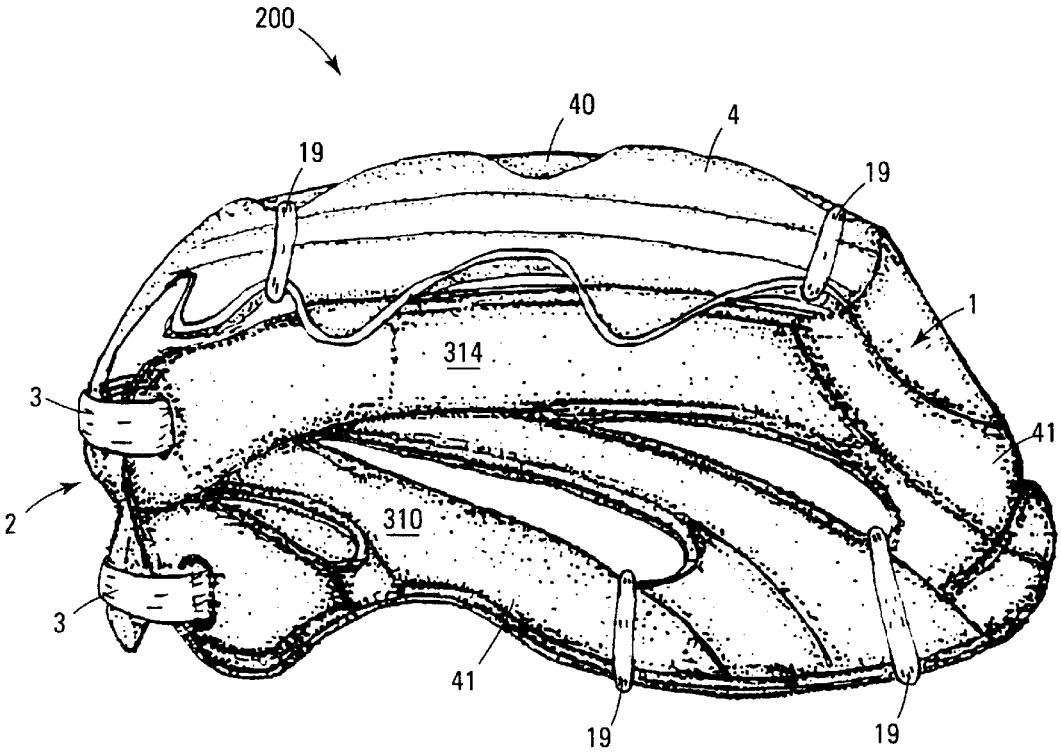
FIG. 27 is a perspective side view of an exemplary headguard in accordance with an embodiment with attachment bands.

Like the embodiment without the spine 4, the embodiment with the spine 4 could include a padded insert 34. The padded insert 34 could attach to the panels 1 and 2 in much the same way as the padded inserts 15 and 17 discussed above. For example, attachment bands 19 could be used. FIG. 26 shows an interior view of the headguard 200 lying flat before assembly. This padded insert 34 could include a channel 35 in the rear portion (unnumbered) located inside 40 of the rear panel 2. This channel 35 could accommodate a ponytail 110. FIG. 27 shows this embodiment with attachment bands 19 attached to the exterior side of the panels 1 and 2 of the headguard 200. In addition, a sleeve 25, similar to the one shown in FIG. 20, could also cover the headguard 200 with the spine 4.

Figure 28:
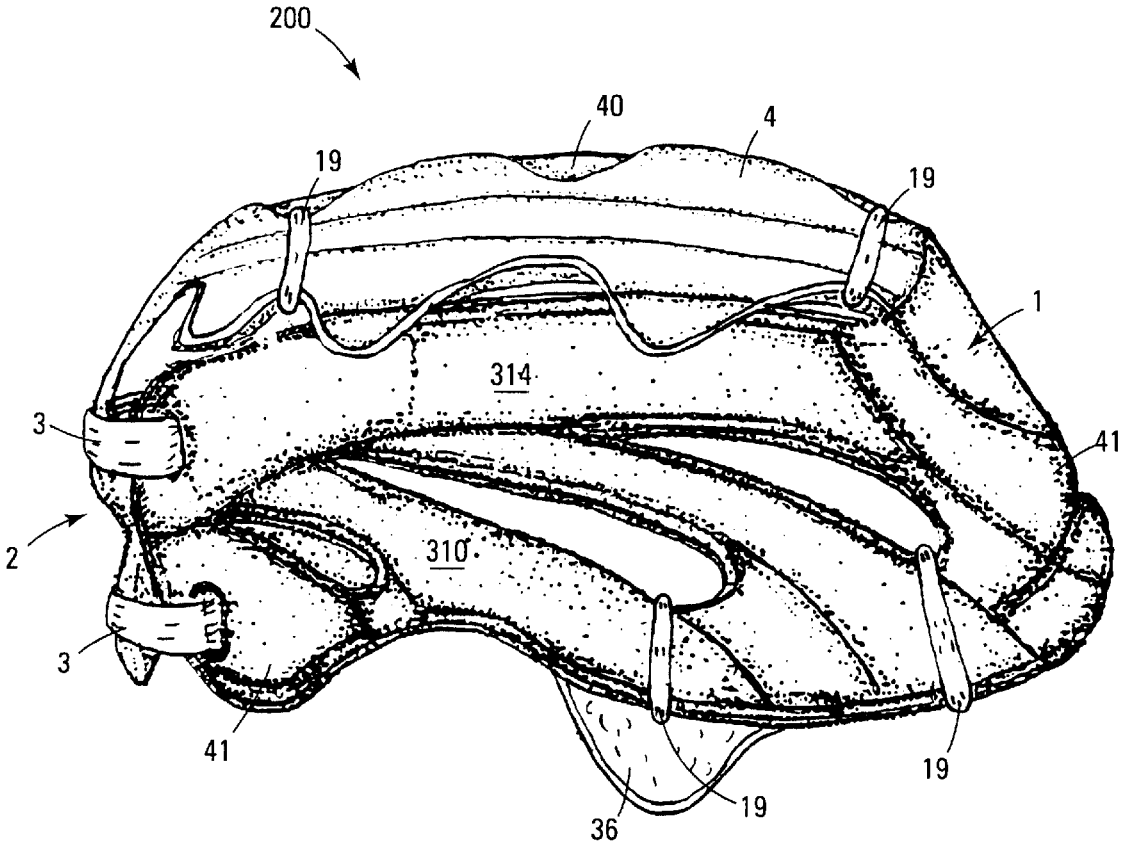
FIG. 28 is a perspective side view of an exemplary headguard with a padded insert that extends to an area around the temple.
Figure 29:
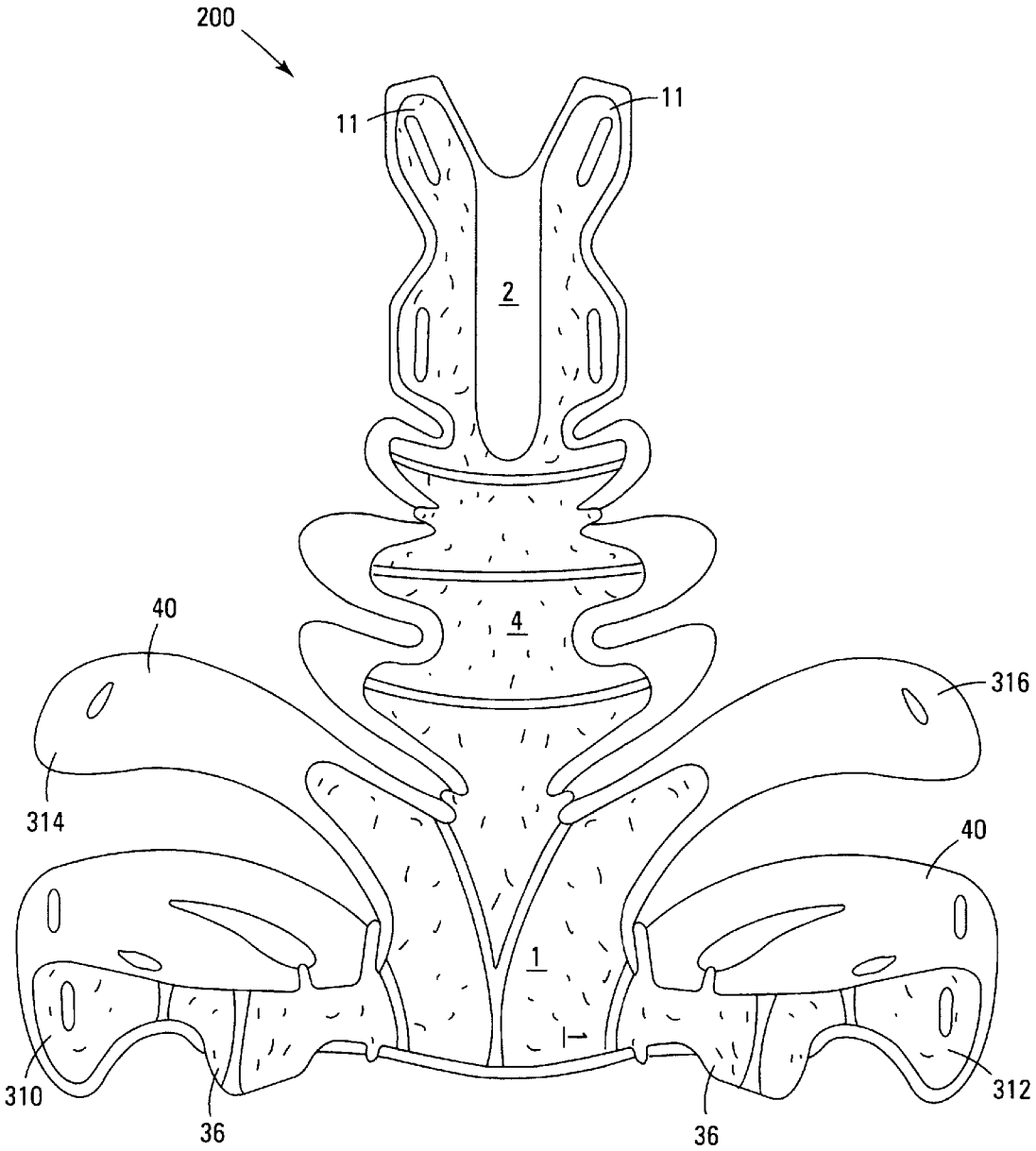
FIG. 29 is an interior view of an unassembled exemplary headguard with a padded insert covering the temple.
Figure 30:
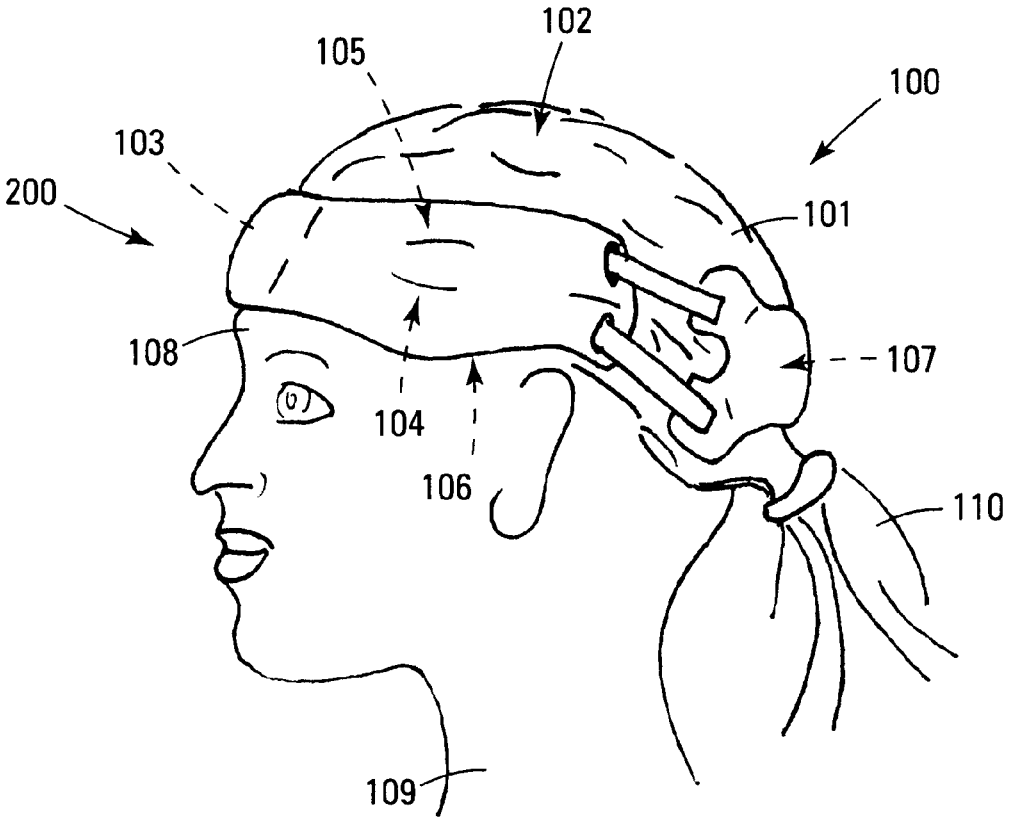
FIG. 30 is a side view of an embodiment of the headguard worn by an athlete with a ponytail running through a slot below the occipital bone.
Figure 31:
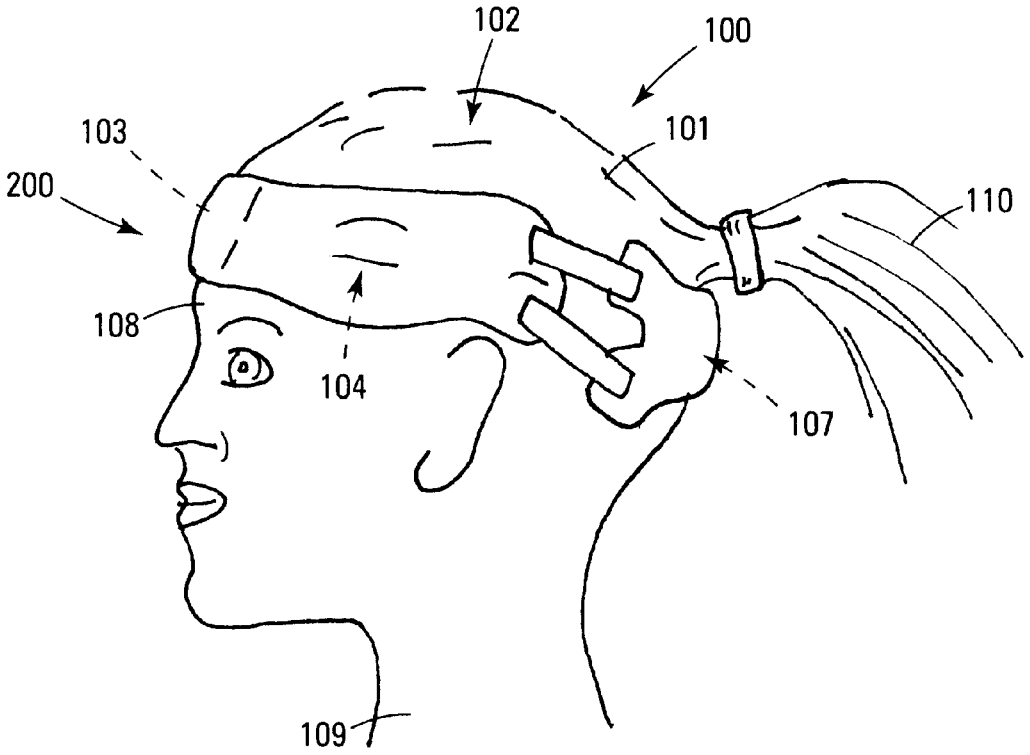
FIG. 31 is a side view of an embodiment of the headguard worn by an athlete with a ponytail running through a slot above the occipital bone.

The padded insert 34 may extend beyond the outline of the padded panels 1 and 2. For example, in the area around the temple 106, a portion 36 of the padded insert 34 could extend below the front panel 1 to cover more of the temple 106, as shown in FIGS. 28 and 29. The edge of the front panel 1 also could be extended to cover this same area of the temple 106.

An Embodiment Without Side Ribs

Figure 32:
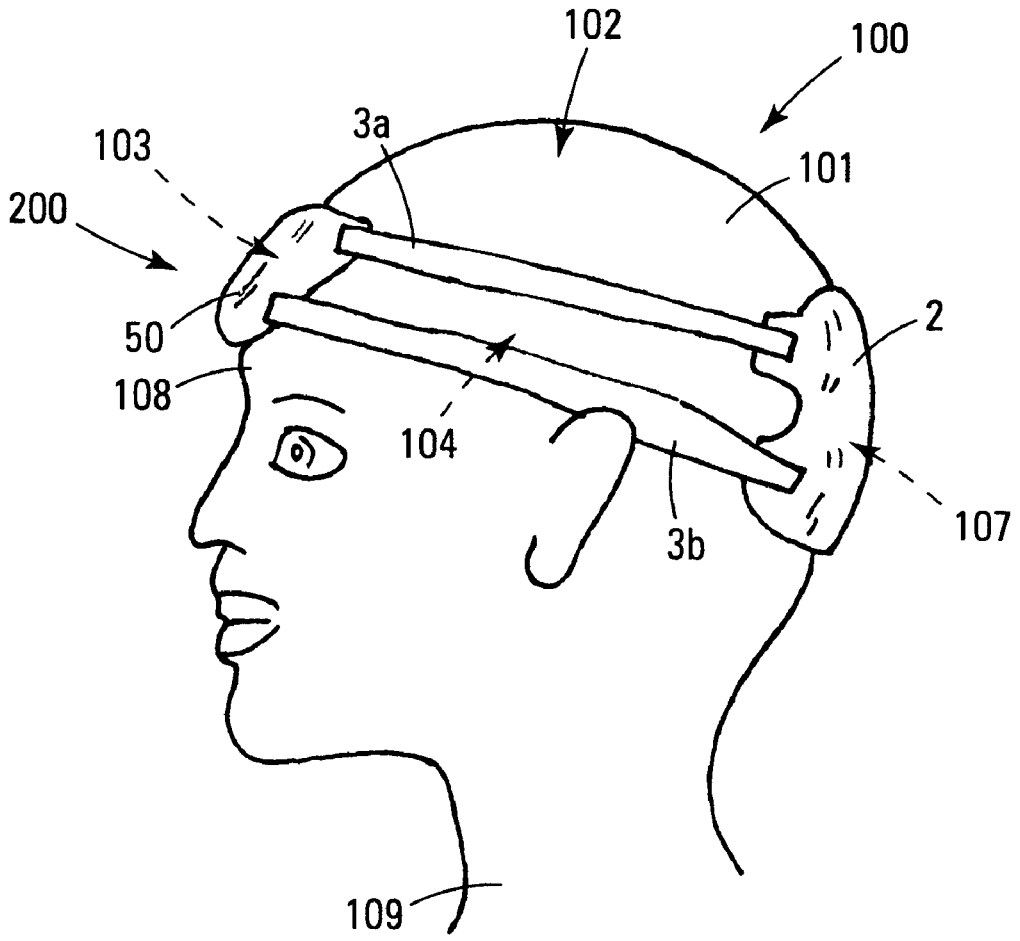
FIG. 32 is a side view of an embodiment of the headguard worn by an athlete without the side ribs.

The embodiments described above include a central pad 50 covering the forehead area 103 and side ribs 310, 312,

314 and 316 covering the side of the head 104 as part of the front panel 1. The embodiment disclosed in FIG. 32 is of a front panel 1 without side ribs 310, 312, 314 and 316. The elimination of the side ribs 310, 312, 314 and 316 may be desirable in certain instances. For example, in training players 100 to head the ball (not shown) properly, it may be advantageous to cover with padding (not shown) that portion of the head 101 best used for striking the soccer ball (not shown), namely the forehead 103.

This embodiment, like those described above, reveals an invention with two adjustment strap systems, an upper adjustment strap system 3*a* and a lower adjustment strap system 3*b*. The upper adjustment strap system 3*a* maintains a line of retention that runs from an area above the occipital bone (not shown) along the side of the head 104 to an area above the frontal bone (not shown). The lower adjustment strap system 3*b* maintains a line of retention that runs from an area below the occipital bone (not shown) along the side of the head 104 to an area below the frontal bone (not shown) but above the brow 108.

These two adjustment strap systems 3*a* and 3*b* help keep the headguard 200 in the proper position on the head 101 of the player 100. They do so because the circumference of the head 101 is generally greater in the area between these two lines. Therefore pressure against the head 101 along these two lines tends to keep the headguard 200 in proper position on the head 101. This is particularly important in a piece of headwear 200 in which some embodiments do not cover the top of the head 102 or which may not have a chinstrap (not shown).

With the elimination of the side ribs 310, 312, 314 and 316, as disclosed here, the lines of retention are created with adjustment straps 3 that fasten directly to the central pad 50 and the rear pad 2. In the embodiments described above the adjustment straps 3 fasten to the side ribs 310, 312, 314 and 316 and the rear pad 2. The line of retention is maintained through the side ribs 310, 312, 314 and 316 to the front pad 318 because the side ribs 310, 312, 314 and 316 and front pad 318 in those embodiments are composed of continuous material. Thus, whether side ribs 310, 312, 314 and 316 are used or not, the upper and lower lines of retention can be maintained.

Demarcation of the Header Target Location

Figure 33:
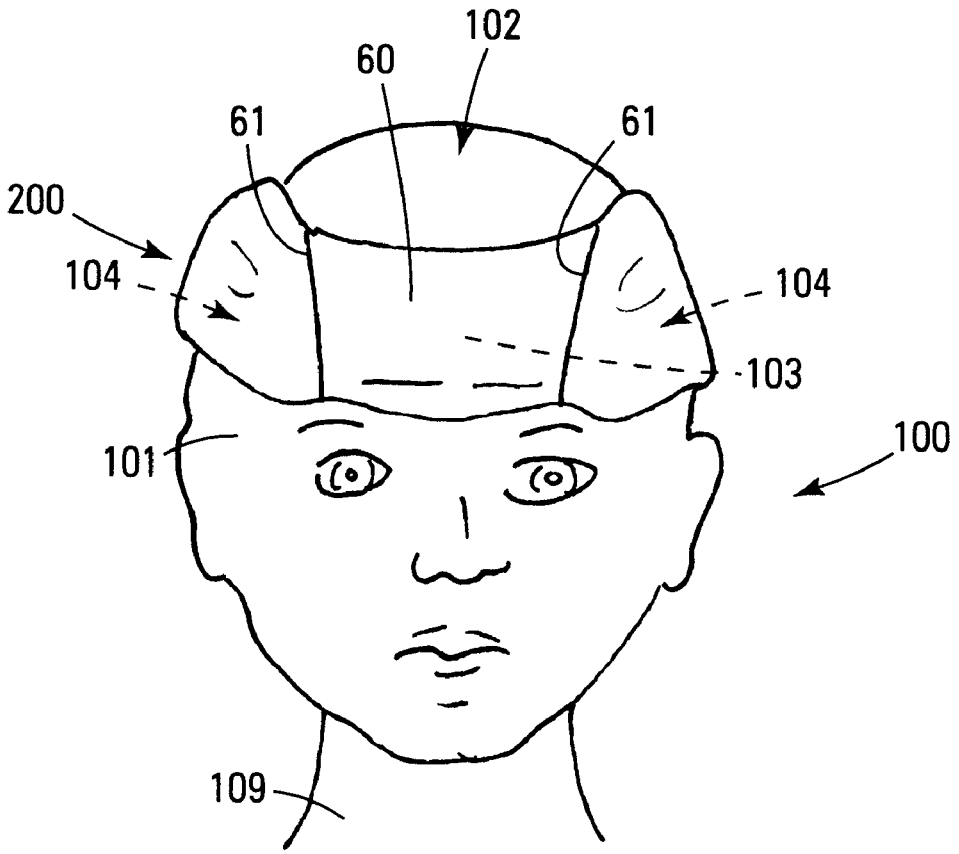
FIG. 33 is a front view of an embodiment of the headguard worn by an athlete with lines demarcating header target location.

The embodiment shown in FIG. 33 discloses a refined header target location 60. A header target location 60 may be desirable in training a player 100 to head a soccer ball (not shown) off the forehead 103 or a specified portion of the forehead 103.

In FIG. 33 the header target location 60 is defined by channels 61 of recessed padding (not shown). The recessed padding (not shown) follows along lines which, when the headguard 200 is worn, generally trace the lateral portions of the frontalis or other portion of the head 101 which defines the transition from the forehead 103 to the side of the head 104. Lines could also demarcate smaller areas such as that defined by the medial portions of the frontalis (unnumbered). Other ways to define the line could include graphics or different colors. The purpose of the identification of the header target location 60 is to make it perceptible to the player 100 wearing the headguard 200 or to other persons such as a coach (not shown).

What is claimed:

1. A protective headguard to be worn by an athlete, comprising:

a) a protective central pad configured and arranged to cover at least a portion of the athlete's forehead when the headguard is worn;

b) a rear pad configured and arranged to cover at least a portion of the athlete's occipital bone when the headguard is worn; and c) an adjustable strap system interconnecting the rear pad and the central pad, d) wherein neither side of the athlete's head is covered by protective padding when the headguard is worn.

2. A protective headguard to be worn by an athlete, comprising:

a) a protective central pad configured and arranged to cover at least a portion of the athlete's forehead when the headguard is worn;

b) a channel defined by the central pad configured and arranged to extend substantially horizontally above the athlete's brow ridges and below the athlete's frontal bone when the headguard is worn;

c) a rear pad configured and arranged to cover at least a portion of the athlete's occipital bone when the headguard is worn; and d) an adjustable strap system interconnecting the rear pad and the central pad.

3. A protective headguard to be worn by an athlete, comprising:

a) a protective central pad configured and arranged to cover at least a portion of the athlete's forehead when the headguard worn;

b) a rear pad configured and arranged to cover at least a portion of the athlete's occipital bone when the headguard is worn;

c) a slot in the rear pad configured and arranged to extend substantially vertically from the athlete's occipital bone and accommodate passage of a ponytail when the headguard is worn; and d) an adjustable strap system interconnecting the rear pad and the central pad.

4. A protective headguard to be worn by an athlete, comprising:

a) a protective central pad having an interior surface, and configured and arranged to cover at least a portion of the athlete's forehead when the headguard is worn;

b) a single unitary liner releasably attached to and covering at least a major portion of the interior surface of the central pad;

c) a rear pad configured and arranged to cover at least a portion of the athlete's occipital bone when the headguard is worn; and d) an adjustable strap system interconnecting the rear pad and the central pad.

5. A protective headguard to be worn by an athlete, comprising:

a) a protective central pad having an interior surface, and configured and arranged to cover at least a portion of the athlete's forehead when the headguard is worn;

b) a unitary liner covering at least a portion of the interior surface of the central pad;

c) bands encircling the central pad and releasably securing the liner to the central pad;

d) a rear pad configured and arranged to cover at least a portion of the athlete's occipital bone when the headguard is worn; and e) an adjustment strap system interconnecting the rear pad and the central pad.

6. A protective headguard to be worn by an athlete, comprising:

a) a protective central pad having an interior surface and an exterior surface, and configured and arranged to cover at least a portion of the athlete's forehead when the headguard is worn;

b) a removable sleeve covering at least a portion of the interior and exterior surfaces of the central pad;

c) a rear pad configured and arranged to cover at least a portion of the athlete's occipital bone when the headguard is worn; and d) an adjustable strap system interconnecting the rear pad and the central pad.

7. A protective headguard to be worn by an athlete, comprising:

a) a protective front panel including (i) a central pad configured and arranged to cover at least a portion of the athlete's forehead when the headguard is worn, (ii) a first side rib extending from the central pad, and configured and arranged to cover at least a portion of a first side of the athlete's head when the headguard is worn, and (iii) a second side rib extending from the central pad, and configured and arranged to cover at least a portion of a second side of the athlete's head when the headguard is worn;

b) a rear pad configured and arranged to cover at least a portion of the athlete's occipital bone when the headguard is worn;

c) a spine pad extending from the front panel to the rear pad, and configured and arranged to cover a top portion of the athlete's head;

d) a means for releasably attaching the spine pad to the first and second side ribs; and e) an adjustable strap system interconnecting the rear pad and the front panel.

8. A protective headguard to be worn by an athlete, comprising:

a) a protective central pad having an exterior surface, and configured and arranged to cover at least a portion of the athlete's forehead and lateral frontalis when the headguard is worn;

b) perceptible lines of demarcation on the exterior surface of the central pad beginning proximate the lateral frontalis and extending towards the brow when the headguard is worn;

c) a rear pad configured and arranged to cover at least a portion of the athlete's occipital bone when the headguard is worn; and d) an adjustable strap system interconnecting the rear pad and the central pad.

9. The headguard of claim 1 wherein the adjustable strap system includes an upper adjustment strap interconnecting a top portion of the rear pad and a top portion of the central pad, and a lower adjustment strap interconnecting a lower portion of the rear pad and a lower portion of the central pad.

10. The headguard of claim 2 wherein the adjustable strap system includes an upper adjustment strap interconnecting a top portion of the rear pad and a top portion of the central pad, and a lower adjustment strap interconnecting a lower portion of the rear pad and a lower portion of the central pad.

11. The headguard of claim 3 wherein the adjustable strap system includes an upper adjustment strap interconnecting a top portion of the rear pad and a top portion of the central pad, and a lower adjustment strap interconnecting a lower portion of the rear pad and a lower portion of the central pad.

12. The headguard of claim 4 wherein the adjustable strap system includes an upper adjustment strap interconnecting a top portion of the rear pad and a top portion of the central pad, and a lower adjustment strap interconnecting a lower portion of the rear pad and a lower portion of the central pad.

13. The headguard of claim 5 wherein the adjustable strap system includes an upper adjustment strap interconnecting a top portion of the rear pad and a top portion of the central pad, and a lower adjustment strap interconnecting a lower portion of the rear pad and a lower portion of the central pad.

14. The headguard of claim 6 wherein the adjustable strap system includes an upper adjustment strap interconnecting a top portion of the rear pad and a top portion of the central pad, and a lower adjustment strap interconnecting a lower portion of the rear pad and a lower portion of the central pad.

15. The headguard of claim 7 wherein the adjustable strap system includes an upper adjustment strap interconnecting a top portion of the rear pad and a top portion of the front panel, and a lower adjustment strap interconnecting a lower portion of the rear pad and a lower portion of the front panel.

16. The headguard of claim 8 wherein the adjustable strap system includes an upper adjustment strap interconnecting a top portion of the rear pad and a top portion of the central pad, and a lower adjustment strap interconnecting a lower portion of the rear pad and a lower portion of the central pad.

17. The headguard of claim 4 wherein the liner is a padded insert.

18. The headguard of claim 5 wherein the liner is a padded insert.

19. The headguard of claim 2, wherein (i) the central pad has first and second sides and (ii) the headguard further includes (A) a first side rib extending from the first side of the central pad which is configured and arranged to cover at least a portion of a first side of the athlete's head when the headguard is worn and (B) a second side rib extending from the second side of the central pad which is configured and arranged to cover at least a portion of a second side of the athlete's head when the headguard is worn.

20. The headguard of claim 3, wherein (i) the central pad has first and second sides and (ii) the headguard further includes (A) a first side rib extending from the first side of the central pad which is configured and arranged to cover at least a portion of a first side of the athlete's head when the headguard is worn and (B) a second side rib extending from the second side of the central pad which is configured and arranged to cover at least a portion of a second side of the athlete's head when the headguard is worn.

21. The headguard of claim 4, wherein (i) the central pad has first and second sides and (ii) the headguard further includes (A) a first side rib extending from the first side of the central pad which is configured and arranged to cover at least a portion of a first side of the athlete's head when the headguard is worn and (B) a second side rib extending from the second side of the central pad which is configured and arranged to cover at least a portion of a second side of the athlete's head when the headguard is worn.

22. The headguard of claim 5, wherein (i) the central pad has first and second sides and (ii) the headguard further includes (A) a first side rib extending from the first side of the central pad which is configured and arranged to cover at least a portion of a first side of the athlete's head when the headguard is worn and (B) a second side rib extending from the second side of the central pad which is configured and arranged to cover at least a portion of a second side of the athlete's head when the headguard is worn.

23. The headguard of claim 6, wherein (i) the central pad has first and second sides and (ii) the headguard further includes (A) a first side rib extending from the first side of the central pad which is configured and arranged to cover at least a portion of a first side of the athlete's head when the headguard is worn and (B) a second side rib extending from the second side of the central pad which is configured and arranged to cover at least a portion of a second side of the athlete's head when the headguard is worn.

24. The headguard of claim 8, wherein (i) the central pad has first and second sides and (ii) the headguard further includes (A) a first side rib extending from the first side of the central pad which is configured and arranged to cover at least a portion of a first side of the athlete's head when the headguard is worn and (B) a second side rib extending from the second side of the central pad which is configured and arranged to cover at least a portion of a second side of the athlete's head when the headguard is worn.

25. The protective headguard of claim 3, wherein the slot in the rear pad is adapted to extend below the occipital bone.

26. The protective headguard of claim 3, wherein the slot in the rear pad is adapted to extend above the occipital bone.

27. The headguard of claim 4, wherein the liner is releasably attached to the central pad by hook and loop fasteners.

28. The headguard of claim 17, wherein the liner is releasably attached to the central pad by hook and loop fasteners.

29. The headguard of claim 7 wherein the front panel, spine pad and rear pad are formed from a monolithic piece of padding.

30. The headguard of claim 8 wherein perceptible lines of demarcation outline an area of the head to be used for heading a soccer ball when the headguard is worn.

* * * * *